US006929596B2

(12) United States Patent
Amirkhanian et al.

(10) Patent No.: US 6,929,596 B2
(45) Date of Patent: Aug. 16, 2005

(54) CENTRIFUGE WITH SEPARATE HERO TURBINE

(75) Inventors: Hendrik N. Amirkhanian, Cookeville, TN (US); Kevin C. South, Cookeville, TN (US); Peter K. Herman, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 71 days.

(21) Appl. No.: 10/360,432

(22) Filed: Feb. 7, 2003

(65) Prior Publication Data

US 2004/0157719 A1 Aug. 12, 2004

(51) Int. Cl.[7] ..... B04B 9/06
(52) U.S. Cl. ..... 494/49
(58) Field of Search ..... 416/20 R, 6, 197 A, 416/197 R, 197 B; 494/24, 36, 43, 49, 64, 65, 68–70, 83, 84, 901; 210/168, 171, 232, 354, 360.1, 380.1, 416.5; 184/6.24

(56) References Cited

U.S. PATENT DOCUMENTS

| | | | | | |
|---|---|---|---|---|---|
| 731,215 | A | * | 6/1903 | Patterson | 494/24 |
| 773,220 | A | * | 10/1904 | Patterson | 210/360.1 |
| 2,053,856 | A | * | 9/1936 | Weidenbacker | 494/49 |
| 2,321,144 | A | * | 6/1943 | Jones | 494/49 |
| 2,335,420 | A | * | 11/1943 | Jones | 184/6.24 |
| 2,485,390 | A | * | 10/1949 | Langmuir | 494/60 |
| 2,779,475 | A | * | 1/1957 | Olcott | 210/368 |
| 2,875,949 | A | * | 3/1959 | Balazs | 494/24 |
| 3,108,955 | A | * | 10/1963 | Boyland | 494/24 |
| 3,273,324 | A | * | 9/1966 | Jennings | 494/60 |
| 3,430,853 | A | * | 3/1969 | Kirk et al. | 494/49 |
| 3,857,783 | A | * | 12/1974 | Nishimura et al. | 494/24 |
| 3,879,294 | A | * | 4/1975 | Ellis et al. | 494/49 |
| 4,030,897 | A | * | 6/1977 | Pelzer et al. | 494/24 |
| 4,262,840 | A | * | 4/1981 | Gronert et al. | 494/24 |
| 4,891,041 | A | | 1/1990 | Hohmann et al. | |
| 5,575,912 | A | | 11/1996 | Herman et al. | |
| 5,603,829 | A | | 2/1997 | Baumann | |
| 5,637,217 | A | | 6/1997 | Herman et al. | |
| 5,674,392 | A | | 10/1997 | Christophe et al. | |
| 5,779,618 | A | * | 7/1998 | Onodera et al. | 494/84 |
| 5,795,477 | A | | 8/1998 | Herman et al. | |
| 6,017,300 | A | | 1/2000 | Herman | |
| 6,019,717 | A | | 2/2000 | Herman | |
| 6,210,311 | B1 | * | 4/2001 | May | 494/24 |
| 6,213,929 | B1 | * | 4/2001 | May | 494/24 |
| 6,296,765 | B1 | * | 10/2001 | Brown et al. | 494/68 |
| 6,364,822 | B1 | | 4/2002 | Herman et al. | |
| 6,709,575 | B1 | * | 3/2004 | Verdegan et al. | 210/168 |
| 6,740,026 | B2 | * | 5/2004 | Samways | 494/12 |
| 2001/0012814 | A1 | * | 8/2001 | May et al. | 494/24 |
| 2004/0152578 | A1 | * | 8/2004 | Samways | 494/49 |
| 2004/0157719 | A1 | * | 8/2004 | Amirkhanian et al. | 494/49 |

FOREIGN PATENT DOCUMENTS

| | | | |
|---|---|---|---|
| DE | 10345366 | A1 * | 4/2004 |
| EP | 0980714 | A2 | 2/2000 |
| GB | 784949 | * | 10/1957 |

* cited by examiner

*Primary Examiner*—Charles E. Cooley
(74) *Attorney, Agent, or Firm*—Woodard, Embardt, Moriarty, McNett & Henry LLP

(57) ABSTRACT

A rotor assembly for use as part of a centrifuge for the separation of particulate matter from a fluid includes a collection chamber housing a particulate separation mechanism and a drive chamber including a Hero turbine which assembles to the collection chamber and which is separable from the collection chamber. The interfit between the drive chamber and the collection chamber imparts any drive chamber rotation due to the Hero turbine directly to the collection chamber for rotation and for particulate separation. By making the drive chamber separable from the collection chamber, the collection chamber can be discarded with its accumulated sludge, allowing the drive chamber to be reused.

20 Claims, 26 Drawing Sheets

CENTRIFUGE WITH SEPARATE HERO TURBINE

BACKGROUND OF THE INVENTION

The present invention relates in general to centrifuge designs for separating particulate matter out of a circulating fluid. Suitable particulate separation mechanisms for the present invention include spiral vane and cone-stack technologies, to name two of the possibilities. More specifically, the present invention relates to the use of a Hero turbine as a part of the overall drive mechanism that is used to impart rotary motion to the rotor assembly of the centrifuge. While a cone-stack or spiral vane particulate separation mechanism will preferably be positioned within the rotor shell as the preferred particulate separation means, the present invention is not limited by the type of particulate separation means which may be selected. The cone-stack and spiral vane styles of particulate separation means are believed to represent two of the more efficient arrangements and are selected for the preferred embodiment, in part, for this reason.

It is also helpful to understand the structure and functioning of some of the earlier centrifuge designs which include a Hero turbine in cooperation with a particulate separation mechanism as part of the rotor design. One such earlier centrifuge design is disclosed in U.S. Pat. No. 5,637,217 which issued Jun. 10, 1997 to Herman, et al. The '217 patent is expressly incorporated by reference herein for its disclosure and teaching of the overall centrifuge design and the use of a cone-stack subassembly as part of that centrifuge design. More specifically, the '217 patent discloses a bypass circuit centrifuge for separating particulate matter out of a circulating liquid and includes a hollow and generally cylindrical centrifuge bowl which is arranged in combination with a base plate so as to define a liquid flow chamber. A hollow centertube axially extends up through the base plate into the hollow interior of the centrifuge bowl. The bypass circuit centrifuge is designed so as to be assembled within a cover assembly and a pair of oppositely-disposed, tangential flow nozzles in the base plate are used to spin the centrifuge within the cover so as to cause particles to separate out from the liquid. The interior of the centrifuge bowl includes a plurality of truncated cones which are arranged into a stacked array and are closely spaced so as to enhance the separation efficiency. The incoming liquid flow exits the centertube through a pair of oil inlets and from there is directed into the stacked array of cones. In one embodiment, a top plate, in conjunction with ribs on the inside surface of the centrifuge bowl, accelerate and direct this flow into the upper portion of the stacked array. In another embodiment, the stacked array is arranged as part of a disposable subassembly. In each embodiment, as the flow passes through the channels created between adjacent cones, particle separation occurs as the liquid continues to flow downwardly to the tangential flow nozzles.

Another patent which describes the function of an earlier centrifuge design is disclosed in U.S. Pat. No. 6,364,822 issued Apr. 2, 2002 to Herman et al. The '822 patent is expressly incorporated by reference herein for its disclosure and teaching of the overall centrifuge design. More specifically, the '822 patent discloses a cone-stack centrifuge for separating particulate material out of a circulating fluid which includes a rotor assembly configured with a hollow rotor hub and which is constructed to rotate about an axis by the ejection of the fluid from nozzles in the rotor assembly. The rotor assembly is mounted on a shaft that is attached to the hub of a base. The base further includes a fluid inlet, a passageway connected to the inlet and in fluid communication with the rotor assembly and fluid outlet. A bearing arrangement is positioned between the rotor hub and the shaft for rotary motion of the rotor assembly about the shaft. The base further includes a baffle for re-directing a swirling flow of fluid out of the base in a radial direction and into the fluid outlet.

Having considered the design, construction and operation of the apparata of the '217 and '822 patents, it was recognized that improvements could be possible as part of the design of a fully disposable, molded plastic centrifuge rotor. In prior centrifuge designs, where the fluid being processed is used to impart rotary motion to the rotor, a Hero turbine or an impulse turbine is typically used as part of the rotor construction. Even in those centrifuge designs where a second fluid is used to impart rotary motion to the rotor, a Hero turbine or an impulse turbine can still be used as part of the rotor construction. When an impulse turbine is incorporated into the overall centrifuge design for imparting rotary motion to the rotor, the turbine is typically separate from the collection chamber. One example of this type of impulse turbine construction is found in U.S. Pat. No. 6,017,300 which issued Jan. 25, 2000 to Herman. Another example of this type of impulse turbine construction is found in U.S. Pat. No. 6,019,717 which issued Feb. 1, 2000 to Herman.

With Hero turbine designs, the typical construction is to incorporate the turbine as part of the rotor construction. The constructions disclosed by the '217 and '822 patents are representative of this type of design. Additionally, the incorporation can be effected by casting, metal stamping, and/or by molding plastic.

In an effort to improve upon the designs of Hero turbine centrifuges, consideration was given to alternate design concepts for the present invention. One feature associated with centrifuges which incorporate an impulse turbine is the ability to dispose of the rotor housing once sludge has accumulated without needing to exchange or replace the impulse turbine. It was envisioned, in the context of the present invention, that certain design benefits could be realized if there was some way to separate the Hero turbine from the remainder of the rotor while still using the Hero turbine to impart rotary motion to the rotor portion of the centrifuge.

While evaluating the design options for separating the Hero turbine from the remainder of the rotor, a number of anticipated benefits were envisioned. First, if each time the rotor is replaced after sludge accumulation the turbine is not replaced, there is a cost savings in material. In effect, this means that there is less disposable material at each rotor change cycle or change interval. After assessing the material requirements for some of the current rotor designs which include a Hero turbine, it is estimated that the user (i.e., the customer) now disposes of approximately 350 grams of material at each rotor service interval (i.e., rotor replacement). By separating the Hero turbine from the rotor, according to the present invention, it is estimated that the amount of material now being disposed of can be reduced by approximately 100 grams.

As will be explained and described in the context of the present invention, a portion of the incoming flow of oil is used to drive the Hero turbine and another portion travels downstream to a flow outlet from the rotor shaft into the rotor centertube. The flow through the rotor centertube exits into the collection chamber portion of the rotor. This particular flow outlet is throttled so that the pressure within the rotor collection chamber is reduced. When the Hero turbine is part of the rotor collection chamber, basically the same fluid flow pressure that drives the Hero turbine is present on the interior of the rotor collection chamber. By separating the Hero turbine from the rotor collection chamber, according to the present invention, the collection chamber of the rotor sees a lower pressure. This in turn allows the wall thickness of the collection chamber to be reduced, further reducing the amount of material to be disposed of at each rotor service interval. The ability to design thinner walls for the collection chamber of the rotor, due to the lower pressure, also reduces rotor cost.

Another benefit of separating the Hero turbine from the rotor relates to the overall rotor housing design and to the construction options in view of the lower pressure. This benefit is found in the ability to design the rotor housing as two sections which are joined together by threaded engagement. This particular construction technique, noting that it is one of several which can be used for the rotor housing, enables the user/customer to separate the rotor housing, clean the two housing sections, and reuse them. The use of a liner allows the particulate separation mechanism in the liner to be discarded, but not the outer rotor housing. Once again, this reduces the cost of the rotor and reduces the amount of material which has to be disposed of at each rotor service interval.

Another benefit to be derived by separating the Hero turbine from the rotor relates to the size of the drive chamber which includes the Hero turbine and the physical separation of the flow within that drive chamber from the flow within the collection chamber. Whatever flow turbulence might be present within the collection chamber does not have any effect on the flow within the drive chamber. Further, by controlling the size of the drive chamber to a comparatively small volume in terms of the collection chamber, there is less opportunity for any flow turbulence to develop within the drive chamber. All of this leads to the minimizing, if not the elimination, of any unstable flow characteristics which are presently seen in other Hero turbine drive chambers.

A further benefit anticipated by separating the Hero turbine from the rotor collection chamber relates to the rotor bearings and their particular location. With the present invention, the rotor bearings are arranged separate from the collection chamber of the rotor. This construction approach contributes to reducing the amount of disposable waste and contributes to reducing the overall cost. Changes to or disposal of the rotor collection chamber do not require changes to nor discarding of the bearings.

The specifics of the present invention that contribute to achieving these various benefits will be more fully described in the description of the preferred embodiment and by the accompanying drawings.

SUMMARY OF THE INVENTION

A rotor assembly for use as a part of a centrifuge for the separation of particulate matter from a fluid being processed by the centrifuge according to one embodiment of the present invention comprises a collection chamber constructed and arranged for receipt of a particulate separation mechanism, the collection chamber defining a flow aperture and further including a drive chamber including a Hero turbine and being constructed and arranged to assemble to the collection chamber and to be separable from the collection chamber wherein the drive chamber defines a hollow interior which is in flow communication with the flow aperture of the collection chamber.

One object of the present invention is to provide an improved rotor assembly for a centrifuge.

Related objects and advantages of the present invention will be apparent from the following description.

DESCRIPTION OF THE PREFERRED EMBODIMENTS

Figure 1:
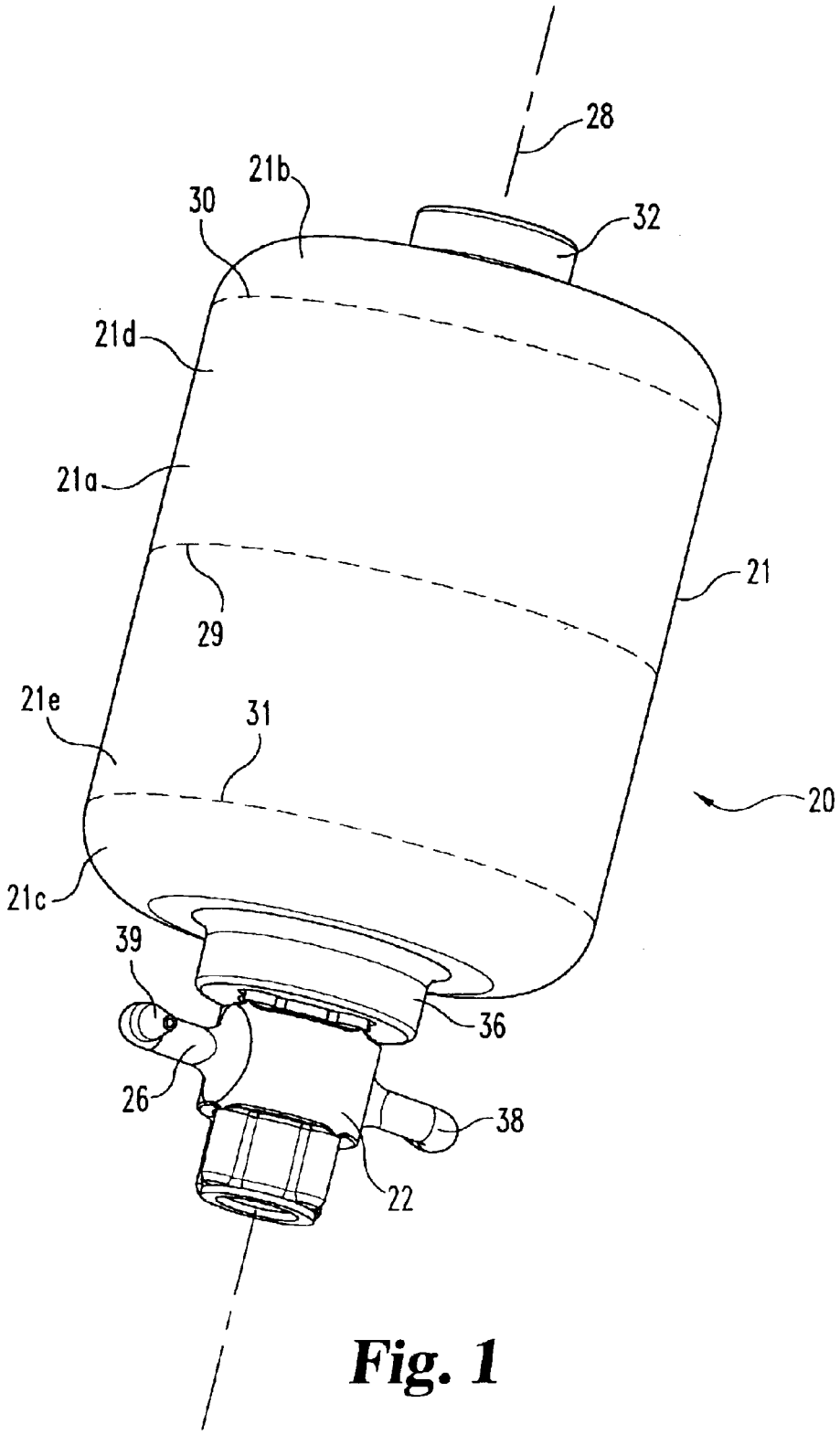
FIG. 1 is a perspective view of a rotor assembly according to a typical embodiment of the present invention.
Figure 2:
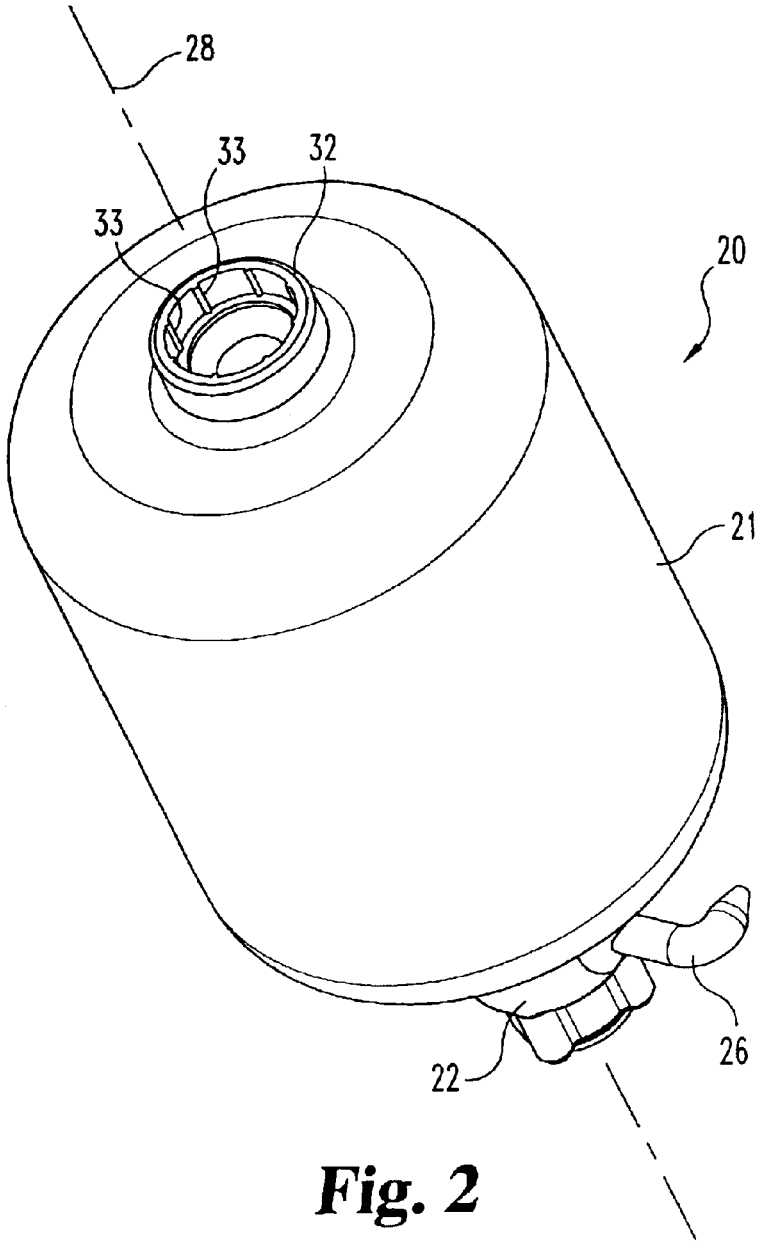
FIG. 2 is a perspective view of the FIG. 1 rotor assembly.
Figure 3:
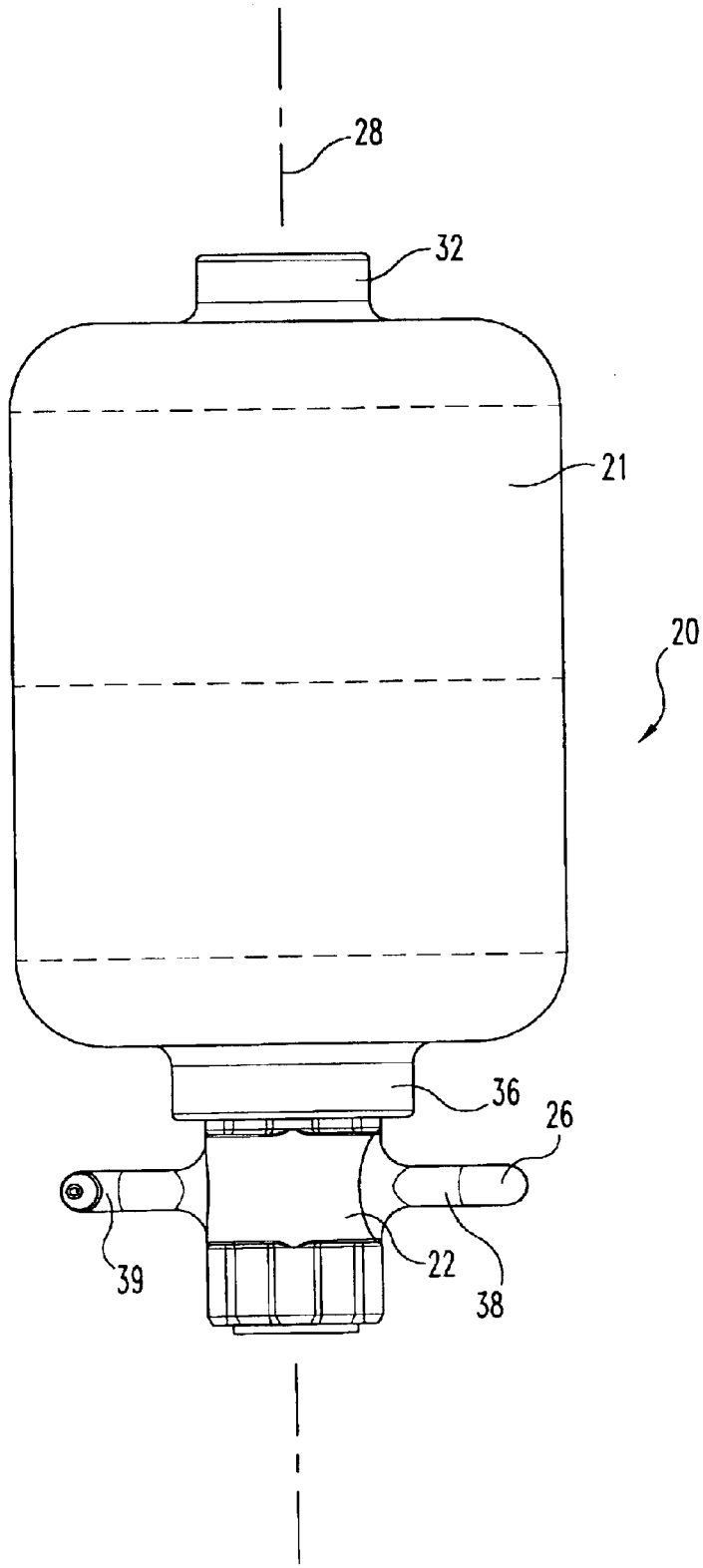
FIG. 3 is a front elevational view of the FIG. 1 rotor assembly.
Figure 4:
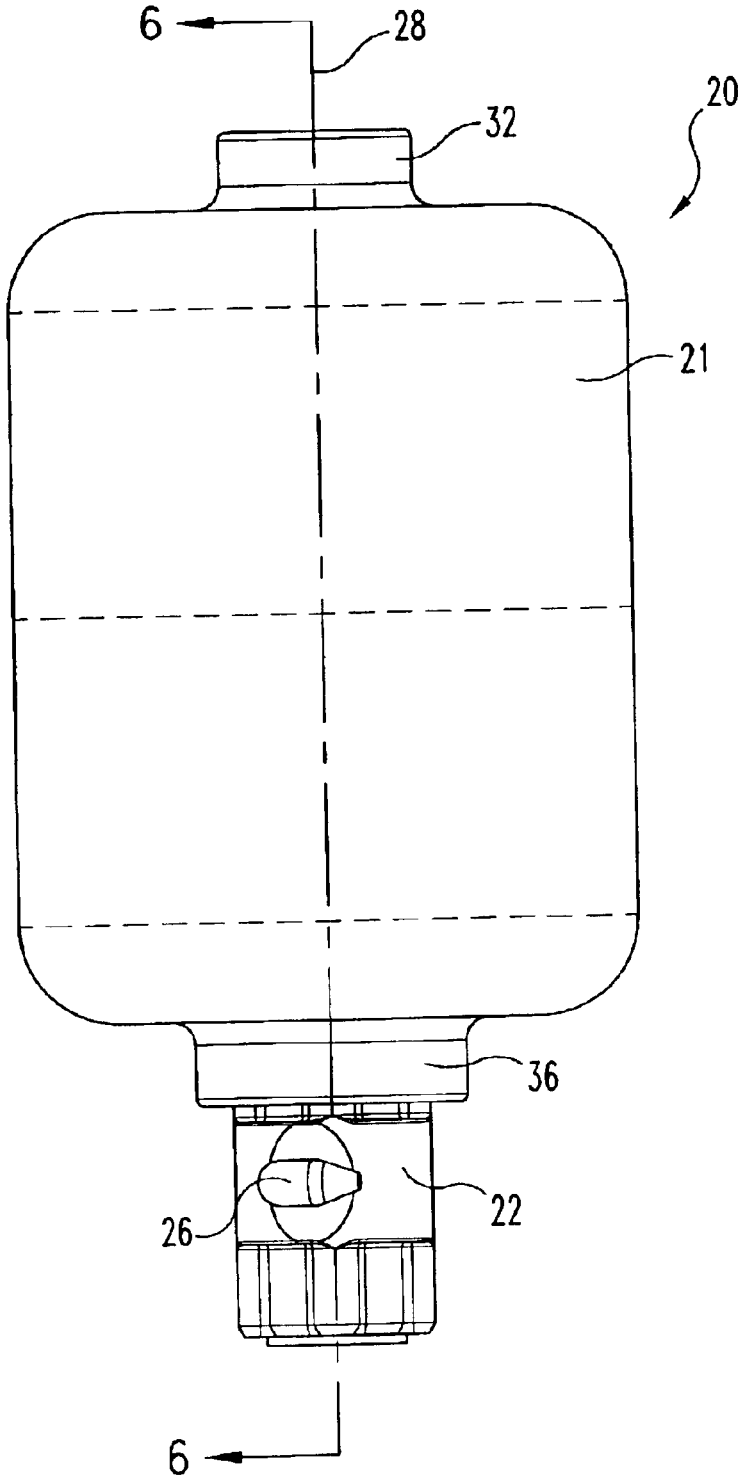
FIG. 4 is a side elevational view of the FIG. 1 rotor assembly.
Figure 5:
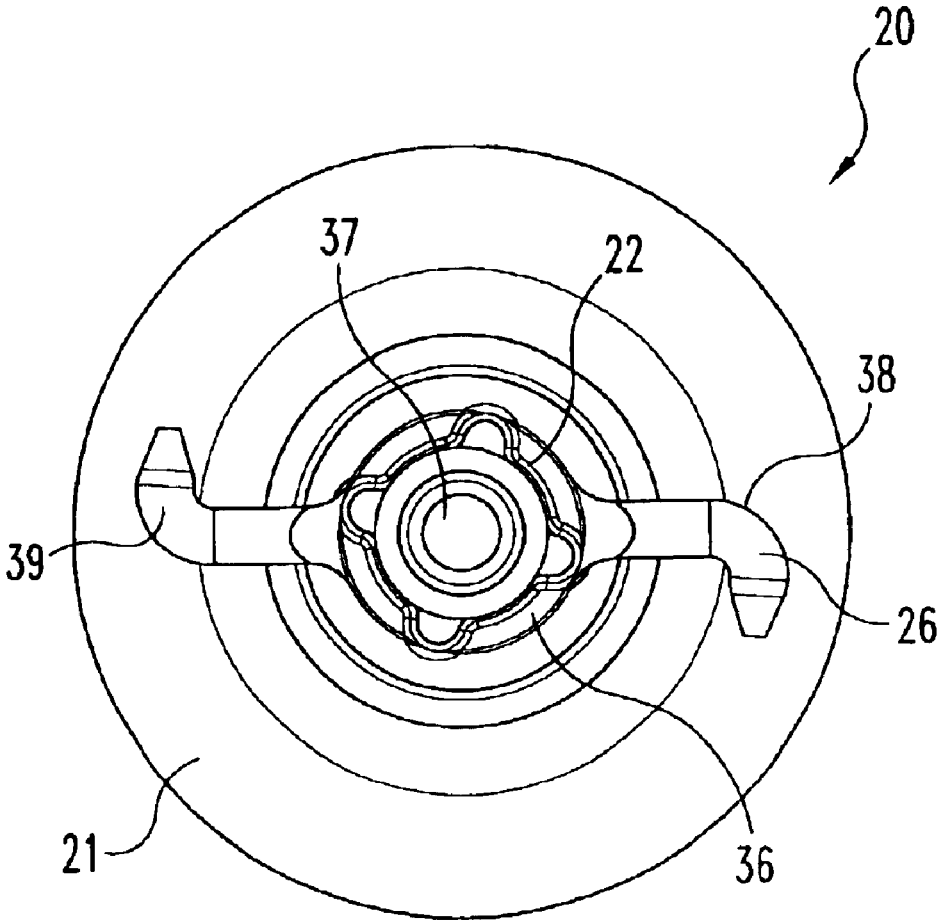
FIG. 5 is a bottom plan view of the FIG. 1 rotor assembly.
Figure 6:
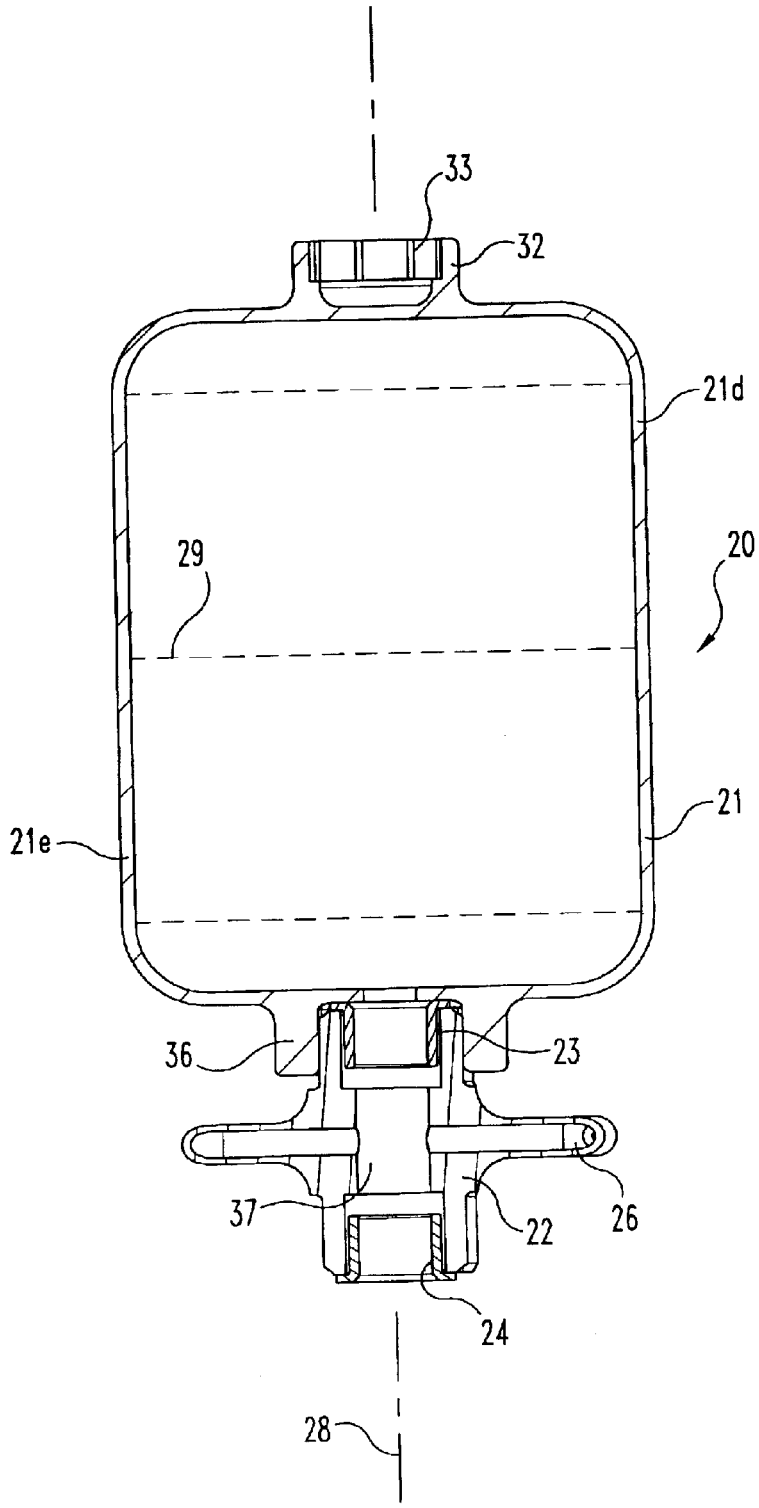
FIG. 6 is a front elevational view, in full section, of the FIG. 1 rotor assembly as viewed along line 6—6 in FIG. 4.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1–7, there is illustrated a rotor assembly 20 for use in a centrifuge (see FIGS. 10 and 11), which is designed for the separation of particulate matter out of a fluid, typically engine oil, which is flowing through the centrifuge. The complete rotor assembly, in an operational sense, includes a selected particulate separation mechanism (not illustrated) which is positioned within rotor housing 21 which is described herein as the rotor collection chamber 21, referring to the "collection" of separated particulate matter (i.e., sludge). While the preferred particulate separation mechanism for the present invention is a cone-stack or spiral vane subassembly, the focus of the present invention is on the rotary drive arrangement (Hero turbine) which imparts rotary motion to the collection chamber 21 so that it can achieve the requisite rpm speed for efficient particulate separation.

Figure 10:
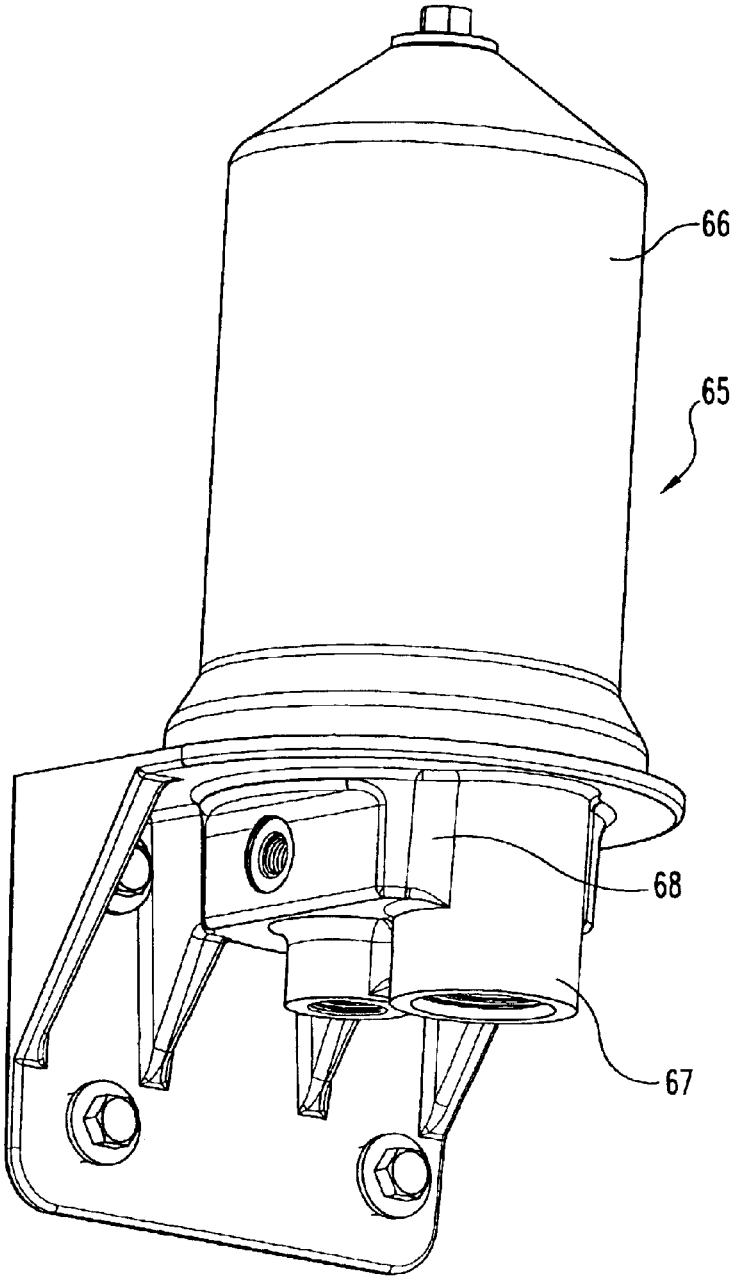
FIG. 10 is a perspective view of a centrifuge assembly which includes the FIG. 1 rotor assembly.
Figure 11:
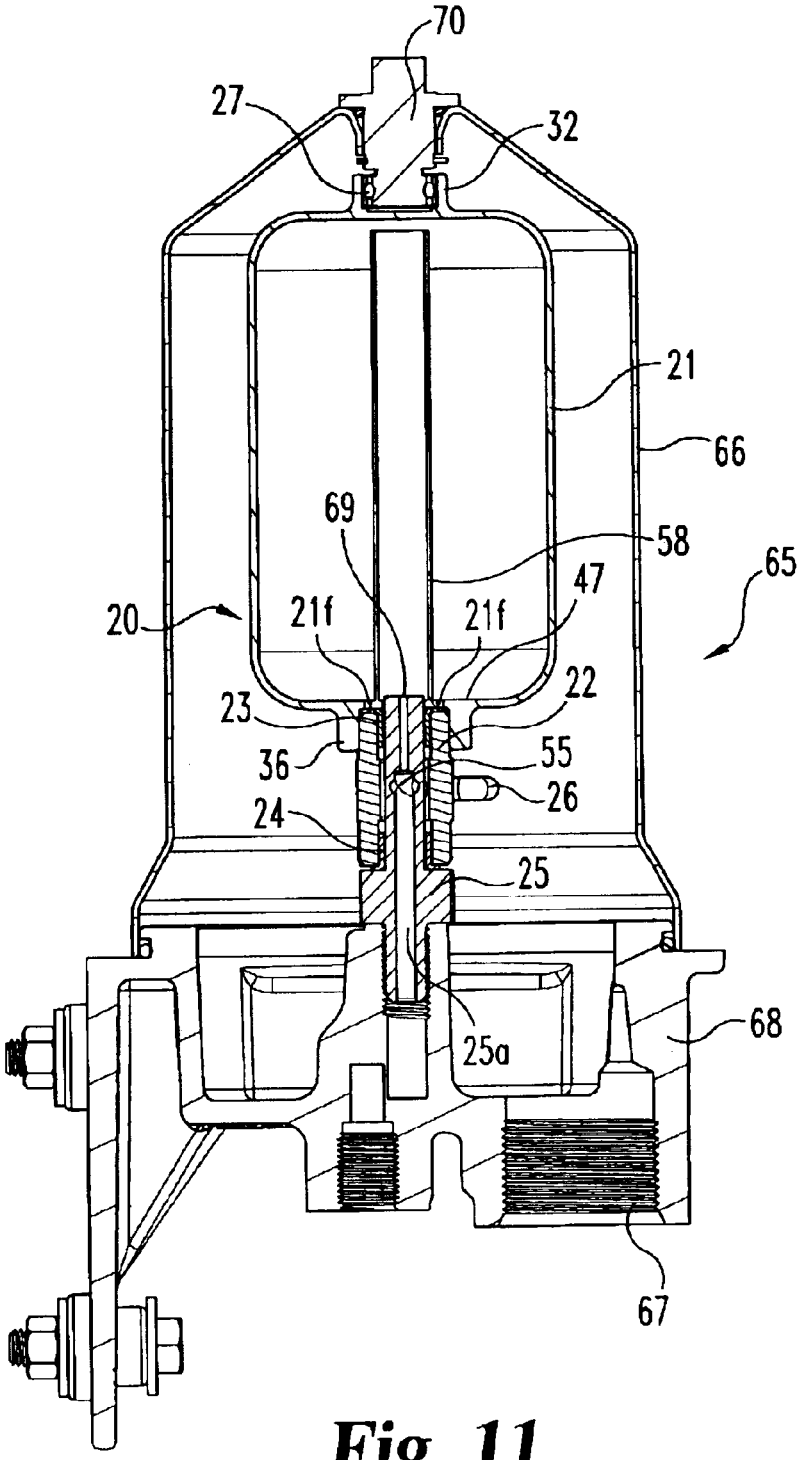
FIG. 11 is a side elevational view, in full section, of the FIG. 10 centrifuge assembly.

As would be understood by reference to those centrifuge patents incorporated by reference herein and as illustrated by the overall centrifuge assembly of FIGS. 10 and 11, the centrifuge 65 includes an outer housing 66 which encloses the rotor assembly 20 and which provides a drain aperture 67 for processed fluid exiting from the rotor assembly. The rotor assembly 20 is typically supported by and rotates about a rotor shaft 25 which is fixed to a portion of the outer housing or base 68 of the centrifuge 65. This particular construction is also disclosed in the centrifuge patents which are incorporated by reference herein.

The interior of the collection chamber 21 includes the particulate separation means or mechanism and there is typically a centertube 58 that functions with the particulate separation mechanism to receive incoming fluid flow and then direct that fluid flow to the particulate separation mechanism for processing and for separating out particulate matter. As described by those centrifuge patents which are incorporated by reference herein, the centertube is generally concentric with the rotor shaft and the rotor shaft defines an oil flow passage which empties into the centertube. A functioning shaft/centertube arrangement which is suitable for the present invention is illustrated in FIG. 11.

With continued reference to FIGS. 1–7 and 11, the primary component parts of rotor assembly 20, noting that the particulate separation mechanism is omitted, include in addition to collection chamber 21, drive chamber 22, upper bearing sleeve 23, lower bearing sleeve 24, and shaft 25. As will be seen with the illustration of FIG. 11, shaft 25 is anchored into the base portion 68 of the overall centrifuge assembly 65 and includes a flow opening 69 at its upper end which opens into centertube 58. The drive chamber 22 is constructed and arranged with a Hero turbine 26 which will be described in greater detail hereinafter.

The collection chamber 21 is an annular member with a generally cylindrical body 21*a* bounded on the top by curved end portion 21*b* and bounded on the bottom by curved end portion 21*c*. Collection chamber 21 is symmetrical about axial centerline 28 and it is axial centerline 28 which represents the axis of rotation for rotor assembly 20. A variety of fabrication techniques are available to create collection chamber 21, including the preferred technique of molding an upper half 21*d* and a lower half 21*e* and then ultrasonically welding those two pieces together into the enclosed, unitary collection chamber 21 illustrated in FIGS. 1–8 and 11. The parting line 29 denotes the location of the joint for molded halves 21*d* and 21*e*. From the perspective of mold size and cost and considering the subsequent assembly steps, molding the two halves, as has been described, is believed to be the preferred manufacturing technique. The preferred material for collection chamber 21 is plastic. By being able to reduce the interior fluid pressure as will be described, the wall thickness for the collection chamber 21 can correspondingly be reduced, saving on cost and resulting in less material which has to be disposed of at each rotor change.

Another suitable fabrication technique for joining the molded pieces (halves) into collection chamber 21 is to use the EMABOND® method which includes inductive heating. A still further option is to mold the two halves 21*d* and 21*e* with mating threads on their adjoining ends and then threadedly connecting one half to the other half. A still further construction option is to initially mold three pieces generally along broken lines 30 and 31 which diagrammatically identify the borders between the cylindrical body 21*a* and end portions 21*b* and 21*c*, respectively. The joinder of these three pieces can also be achieved by any of the three techniques already described, including ultrasonic welding, joining by the EMABOND® method, or by a threaded connection.

Regardless of the specific fabrication method selected for creating the integral collection chamber 21, the upper end portion 21*b* defines a support hub 32 which is constructed and arranged to receive a bearing 27 (preferably a ball bearing) and a support post 70 (see FIG. 11) for facilitating the high rpm rotation of the rotor assembly 20 within the centrifuge 65. The support hub 32 is closed at one end and is configured with a series of eight axially-extending, equally-spaced raised ribs 33. Each raised rib 33 extends radially inwardly a distance of approximately 0.032 inches.

By sizing support hub 32 (excluding the ribs 33) for a slight press fit with the bearing 27, insertion of the bearing down into hub 32 causes a "crushing" of the upper portions of ribs 33 as these portions of the ribs are contacted by the bearing. Due to this crushing of these molded plastic ribs 33, these ribs can be referred to as "crush ribs". The effect of this crushing is to achieve an added degree of interference fit between the bearing 27 and the hub 32 and thus added holding security in order to maintain the bearing in position. A pair of oppositely-disposed, molded abutment tabs can be included as part of hub 32 in order to limit the axial depth of insertion of the bearing down into hub 32.

The lower end portion 21*c* defines a hollow hub 36 which is contoured to securely receive (interfit) a matching (convex) ribbed exterior surface on the drive chamber 22 for a slip-free, sliding interfit between the drive chamber 22 and the collection chamber 21. Due to this secure interfit, any and all rotation of the drive chamber 22 about axial centerline 28, as generated by the Hero turbine 26, is accurately transmitted into rotation of the collection chamber 21, without slippage.

The interior opening 37 of drive chamber 22 which is concentric to axial centerline 28, receives the upper and lower bearing sleeves 23 and 24, respectively. The interior opening 37 which is substantially cylindrical also receives shaft 25, as illustrated in FIG. 11. The shaft, which is received by each of the bearings 23 and 24, is hollow and provides a flow of oil into the interior opening 37 and into the collection chamber 21. As is illustrated, the drive chamber 22 (see also FIG. 9), includes a pair of flow nozzles 38 and 39, each of which define an open passageway 38*a* and 39*a*, respectively, which are in flow communication with the interior opening 37. As defined herein, each "flow nozzle" includes a tubular portion connected to the body of drive chamber 22 and a tapered nozzle tip which ejects the flow. Drive chamber 22, and in particular flow nozzles 38 and 39, are constructed and arranged so as to create an exiting flow jet of fluid (oil) along a path line which is substantially parallel to a tangent line to the cylindrical outer surface of shaft 25. The exiting flow jet from one nozzle 38 or 39 is directed 180 degrees opposite to the direction of the exiting flow jet from the other nozzle 38 or 39. These nozzles cooperate to create a reaction force which imparts rotary motion to the drive chamber 22 and in turn to the collection chamber 21. This nozzle arrangement creates the "Hero turbine" of the present invention.

Figure 8:
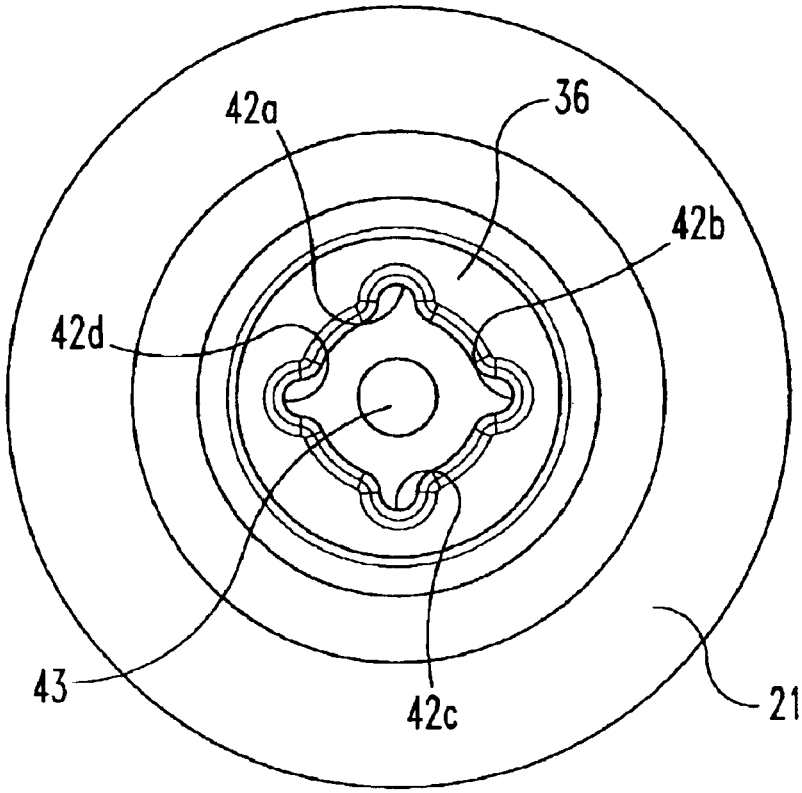
FIG. 8 is a bottom plan view of a rotor collection chamber comprising a portion of the FIG. 1 rotor assembly.

Referring to FIG. 8, there is illustrated a bottom plan view of the collection chamber 21 and its integral hub 36. As previously described, the hollow interior of hub 36 is contoured with axially-extending grooves. There are a total of four grooves 42*a*–42*d* equally-spaced 90 degree apart. The shaft aperture 43 is a cylindrical opening centered in hub 36 and concentric with axial centerline 28. Four drain apertures 21*f* are provided in the lower wall 47 of collection chamber 21 adjacent the outer wall of centertube 58. These four drain apertures 21*f* are provided for the drainage of fluid (oil) after processing by the selected particulate separation means which is assembled into collection chamber 21.

Figure 9:
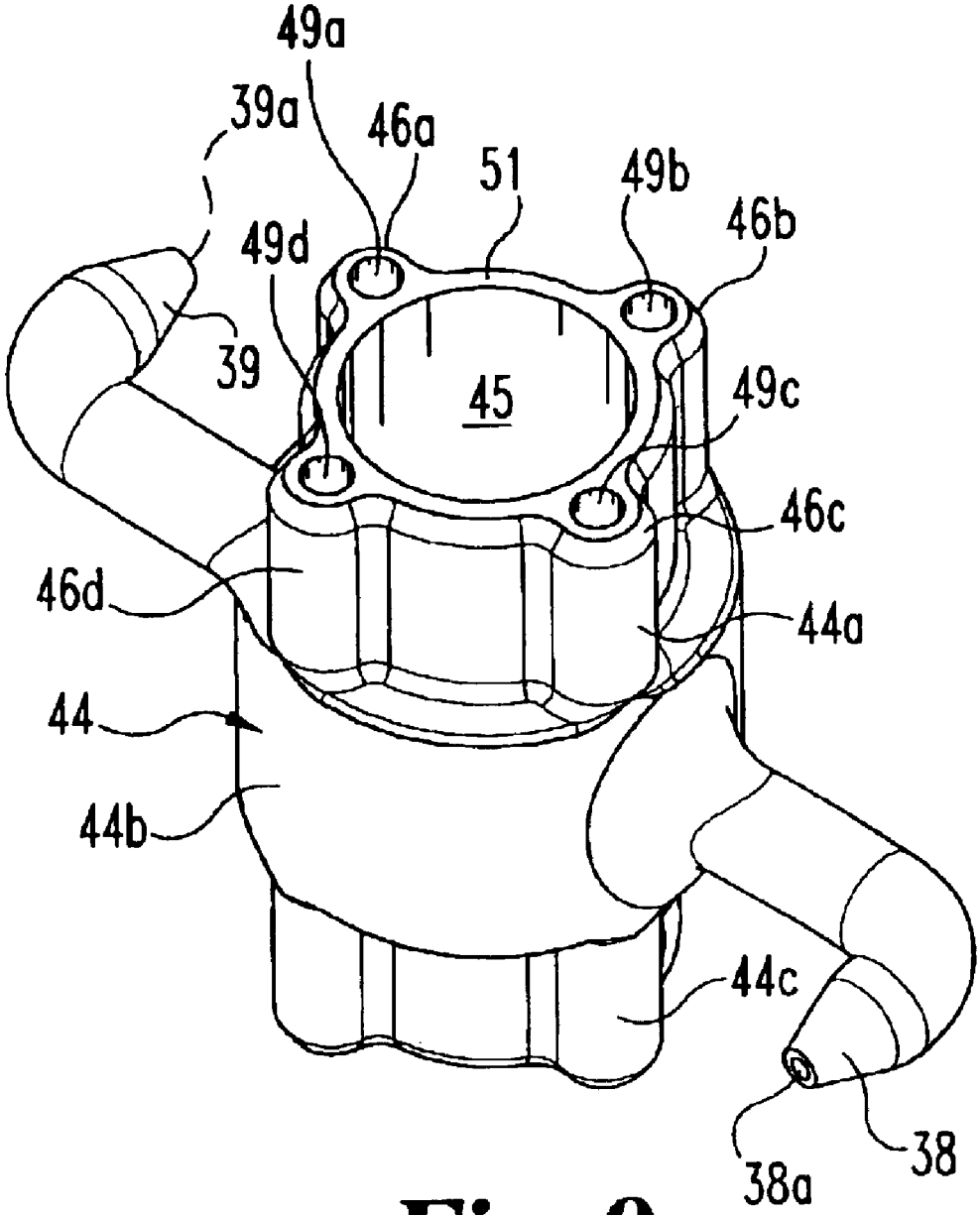
FIG. 9 is a perspective view of a drive chamber including a Hero turbine comprising a portion of the FIG. 1 rotor assembly.

Referring to FIG. 9, a top perspective view of drive chamber 22 is provided, showing flow nozzles 38 and 39 and the main body 44 which is constructed and arranged into three axial sections 44*a*, 44*b*, and 44*c*. Section 44*a* receives upper bearing sleeve 23 in cylindrical aperture 45 and it is section 44*a* that fits into hub 36. The four axially-extending, convex ribs 46*a*–46*d* are equally-spaced 90 degrees apart. The four ribs 46*a*–46*d* are sized and configured to fit within grooves 42*a*–42*d*. This rib-to-groove interfit at four locations approximately 90 degrees apart keys the rotation of the drive chamber 22 to the rotation of the collection chamber 21 via hub 36 such that there is no slippage. This ribbed design is repeated with section 44*c*. The middle section 44*b* is not ribbed and instead is a cylindrical surface, except for the integral construction of flow nozzles 38 and 39. Extending axially the full height of drive chamber 22 are four fluid (oil) drainage holes 49*a*–49*d*, there being one hole each centered in a corresponding one of the axial ribs 46*a*–46*d*. In view of the fact that these drainage holes 49*a*–49*d* extend the full axial height of drive chamber 22, they also extend through and are centered in the corresponding axial ribs of section 44*c*.

The upper bearing sleeve 23 includes a radial flange 50 which fits against the upper surface 51 of section 44*a*. The diameter size of flange 50 is not sufficient to completely cover over the four drainage holes 49*a*–49*d* nor the four drain apertures 21*f*. Since the four drainage holes and the four drain apertures are not closed off by flange 50, a clearance path is left for the drainage of fluid (oil) after being processed by the particulate separation mechanism positioned within the collection chamber 21. This drainage flow exits the collection chamber by way of the four drain apertures 21*f* which are in flow communication with and generally concentric to the drainage holes 49*a*–49*d*. The exiting flow passing through these drainage holes travels to the lower portion of the centrifuge where a main drain aperture 67 is provided.

Shaft 25 is hollow and defines fluid passageway 25*a*. Included as part of shaft 25 and in flow communication with passageway 25*a* are a pair of oppositely disposed fluid outlets 55 which direct the high pressure flow of fluid (oil) into the hollow interior of drive chamber 22 in line with passageways 38*a* and 39*a*. This flow exits the drive chamber 22 by way of flow nozzles 38 and 39 and specifically by way of passageways 38*a* and 39*a*, thereby creating high velocity jets of fluid which create the Hero turbine effect and in turn rotation of the drive chamber about shaft 25. Shaft 25 remains stationary with the surrounding and enclosing centrifuge housing 66. The drive chamber 22 has a relatively small interior volume which is separate and isolated from any movement of the fluid within the collection chamber, particularly rotational motion. This enables the present invention to provide a design which virtually eliminates any unstable flow characteristics within the Hero turbine drive chamber 22. Not only is the interior volume of drive chamber 22 comparatively small relative to the interior volume of the collection chamber 21, shaft 25 takes up most of this interior volume. As a result, the exiting flow from the fluid outlets 55 flows directly toward the passageways 38*a* and 39*a*.

Since not all of the incoming fluid (oil) into shaft 25 is utilized by the Hero turbine, the remainder of the incoming flow is routed to the interior of the collection chamber 21 by way of shaft 25. A metered or throttled orifice flow outlet 69 is defined by shaft 25 and opens directly into the centertube 58. This flow is then routed to the particulate separation mechanism for processing.

It should be noted that the diameter size of outlet 69 is specifically designed to be substantially smaller than the diameter size of passageway 25*a*. The effect of this specific flow sizing is to limit the flow through and reduce the fluid pressure entering the collection chamber 21. The reference to "throttle orifice" flow outlet 69 is intended to help convey an understanding of the function of this design for outlet 69. One of the benefits of the lower pressure is to be able to design the collection chamber 21 with thinner walls. Another benefit is to be able to reduce the risk of blowing open any seal which might be exposed to any pressure within the collection chamber.

While rotor assembly 20 represents the preferred embodiment of the present invention, the present inventors have conceived of other features and alternative arrangements that can be included as part of a rotor assembly with a Hero turbine drive chamber that is external to the rotor collection chamber or housing. These other features and alternative arrangements are illustrated in FIGS. 12–35.

Figure 16:
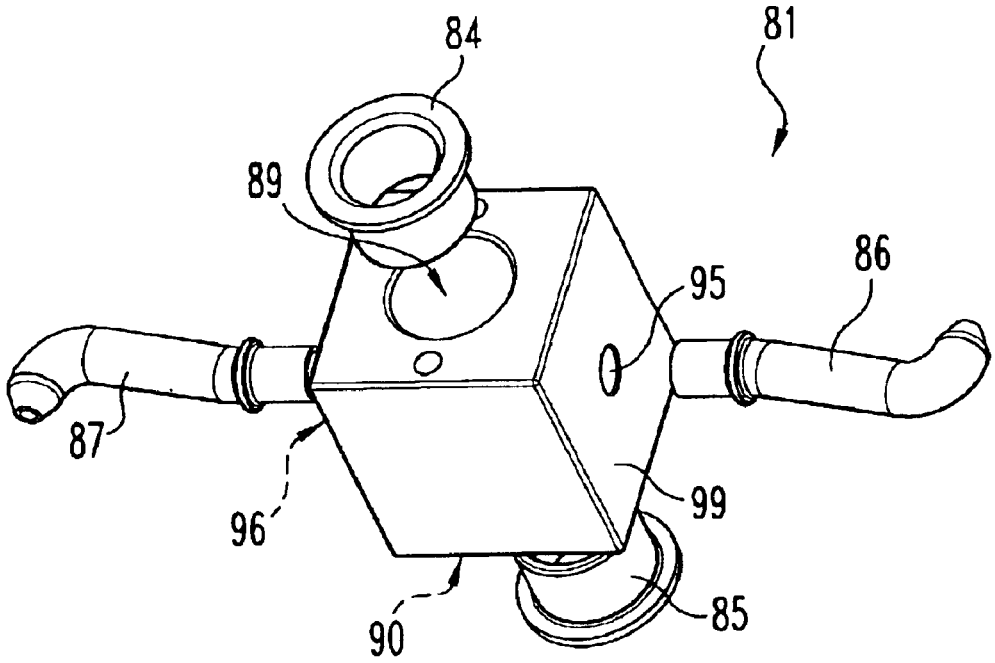
FIG. 16 is an exploded, perspective view of an alternative drive chamber embodiment according to the present invention.
Figure 17:
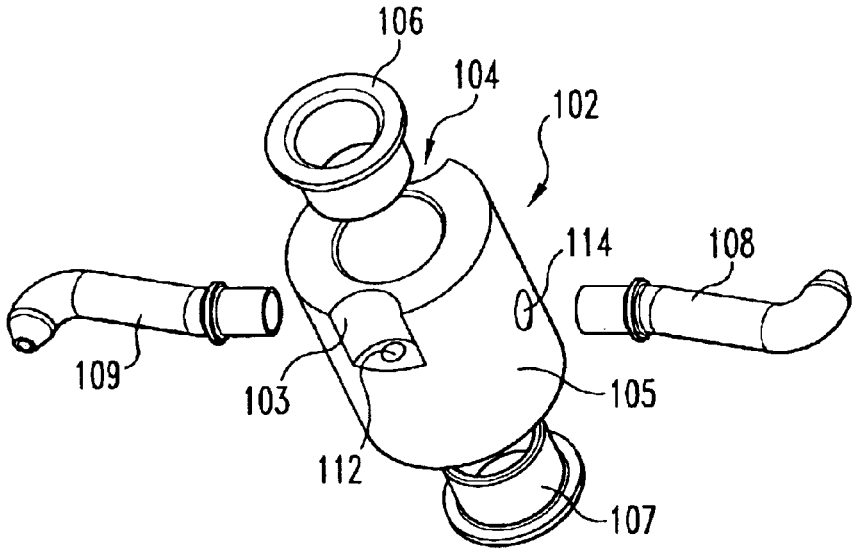
FIG. 17 is an exploded, perspective view of an alternative drive chamber embodiment according to the present invention.
Figure 18:
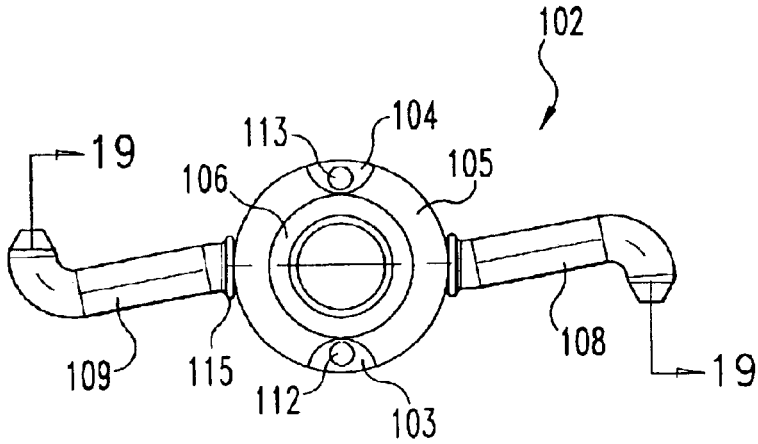
FIG. 18 is a top plan view of the FIG. 17 drive chamber.
Figure 19:
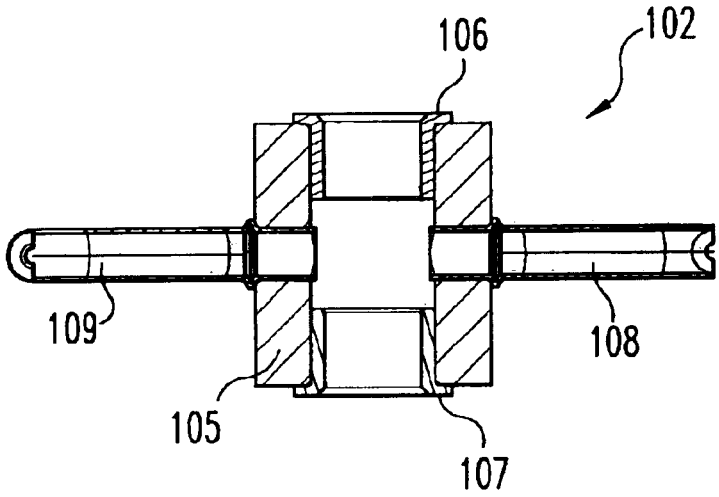
FIG. 19 is a front elevational view, in full section, of the FIG. 17 drive chamber as viewed along line 19—19 in FIG. 18.
Figure 20:
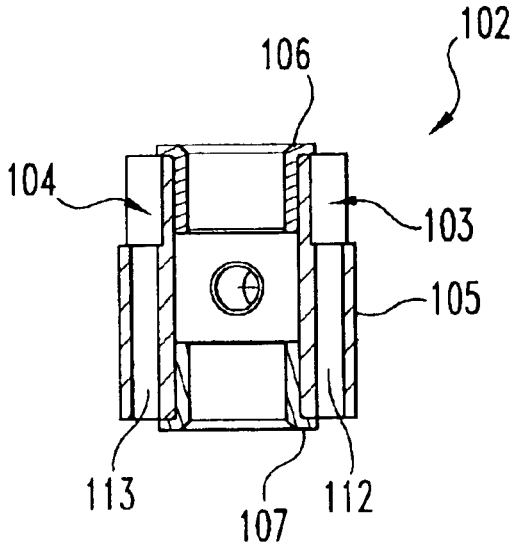
FIG. 20 is a side elevational view, in full section, of the FIG. 17 drive chamber.
Figure 21:
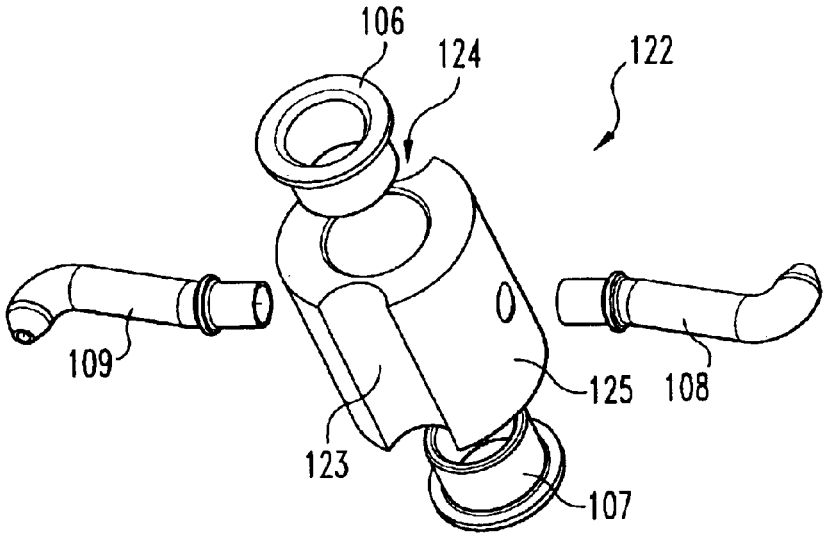
FIG. 21 is an exploded, perspective view of an alternative drive chamber embodiment according to the present invention.
Figure 22:
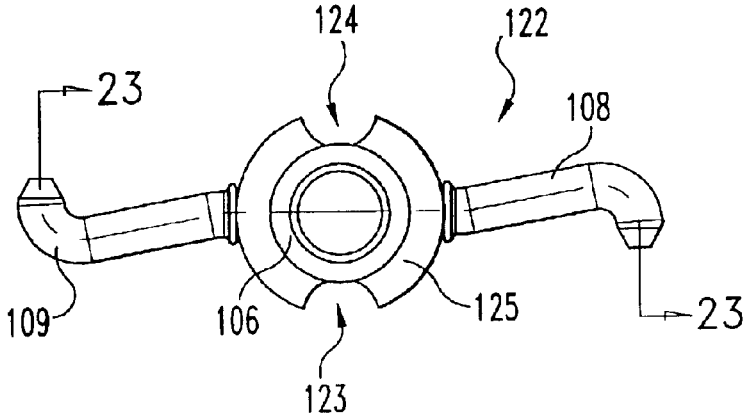
FIG. 22 is a top plan view of the FIG. 21 drive chamber.
Figure 23:
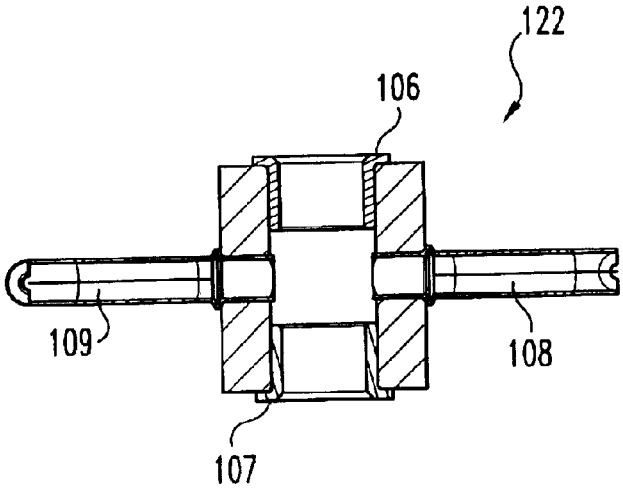
FIG. 23 is a front elevational view, in full section, of the FIG. 21 drive chamber as viewed along line 23—23 in FIG. 22.
Figure 24:
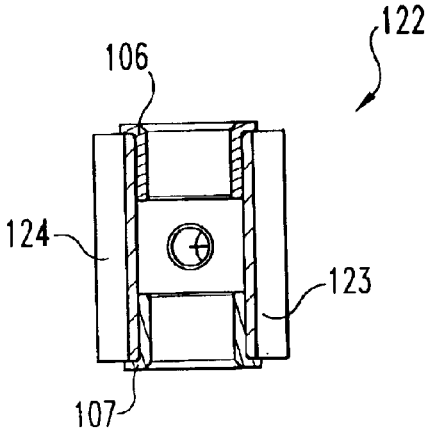
FIG. 24 is a side elevational view, in full section, of the FIG. 21 drive chamber.

Referring first to FIGS. 12–16, three primary features in the form of alternative arrangements are illustrated. First, it will be recalled that hollow hub 36 is contoured to securely receive (interfit) a matching (convex) ribbed exterior surface on the upper section 44*a* of drive chamber 22 for a slip-free, sliding interfit. In lieu of the molded, convex, ribbed exterior on the upper section 44*a*, either that section or alternatively the entirety of drive chamber 22 can be reshaped. In FIGS. 12–15, this reshaped exterior of drive chamber 80 is hex or hexagonally shaped in lateral section. In FIG. 16, this reshaped exterior of drive chamber 81 is square shaped in lateral section and overall is of a cubic form.

With continued reference to FIGS. 12–15, the entire drive chamber 80, except for bushings 84 and 85 and except for flow jet nozzles 86 and 87, has a horizontal cross sectional shape that is hexagonal. As would be understood, the interfit of drive chamber 80 is into the lower hub of the rotor assembly (not illustrated). The main body 88 of drive chamber 80 includes an upper bore 89 for receipt of bushing 84 and a lower bore 90 for receipt of bushing 85. The main body 88 defines a first flow passageway 91 adjacent one "corner" of the hexagonal shape and an oppositely-positioned, second flow passageway 92 adjacent another "corner". Flow passageways 91 and 92 are constructed and arranged and function in a manner similar to drainage holes 49*a*–49*d*. As such, the flanges of bushings 84 and 85 do not cover over so as to close off either passageway 90 and 92. Similarly, it should be understood that additional drainage passageways can be incorporated as part of main body 88.

Figure 12:
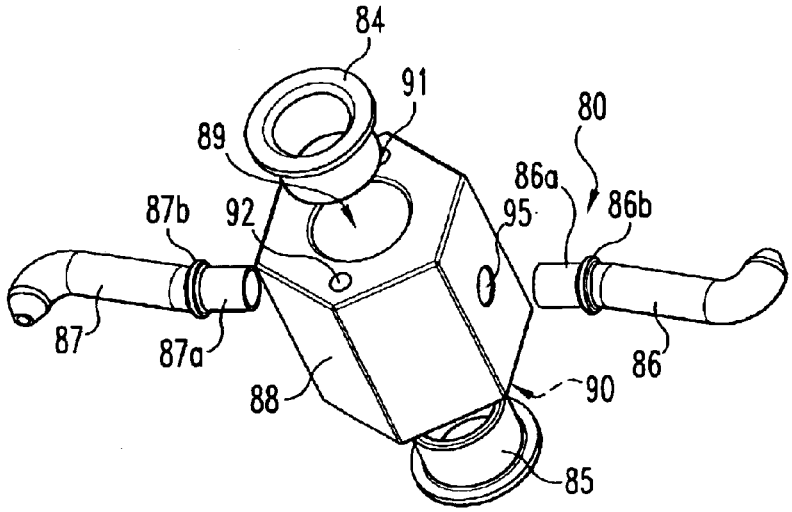
FIG. 12 is an exploded, perspective view of an alternative drive chamber embodiment according to the present invention.
Figure 13:
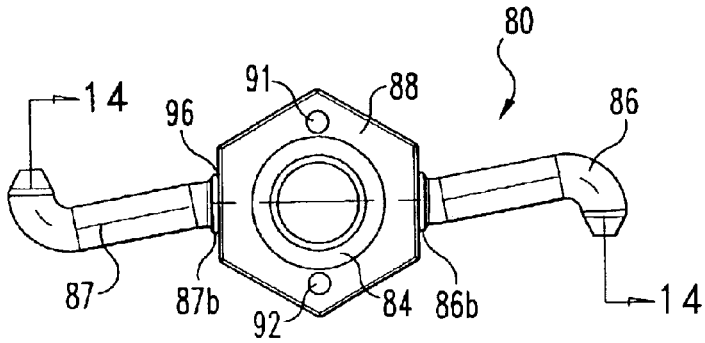
FIG. 13 is a top plan view of the FIG. 12 drive chamber.
Figure 14:
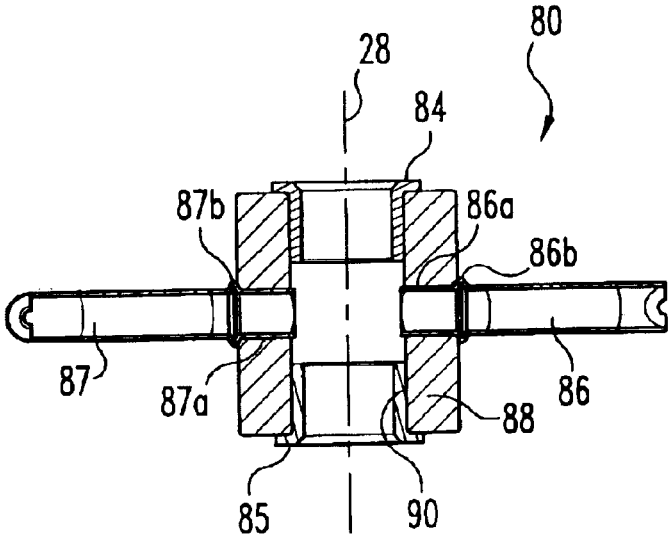
FIG. 14 is a front elevational view, in full section, of the FIG. 12 drive chamber as viewed along line 14—14 in FIG. 13.
Figure 15:
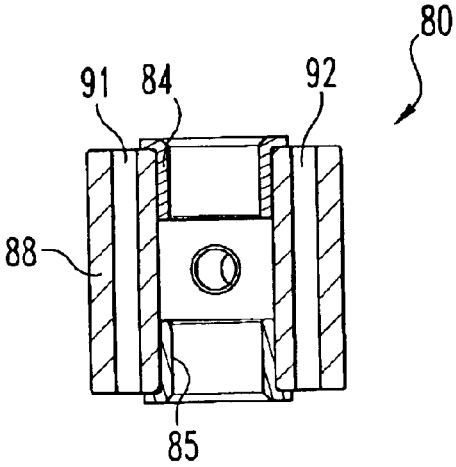
FIG. 15 is a side elevational view, in full section, of the FIG. 12 drive chamber.

A second primary (alternative) feature of the present invention that is illustrated by FIGS. 12–15 includes the separable and insertable nature of jet flow nozzles 86 and 87 into main body 88. The exploded view of FIG. 12 illustrates this feature, noting that main body 88 defines a first jet flow nozzle bore 95 for receipt of one end of jet flow nozzle 86 and an oppositely-positioned, second jet flow nozzle bore 96 for receipt of one end of jet flow nozzle 87.

Each jet flow nozzle 86 and 87 includes a jet tube 86*a* and 87*a*, respectively, and an annular ring seal 86*b* and 87*b*, respectively. Annular ring seal 86*b* is constructed and arranged to seal the annular interface between jet tube 86*a* and bore 95. Annular ring seal 87*b* is constructed and arranged to seal the annular interface between jet tube 87 and bore 96. Main body 88 has a hollow interior such that fluid draining from the rotor collection chamber or rotor housing is able to be used by way of the jet flow nozzles 86 and 87 for the Hero-turbine action (reaction) that in turn spins the rotor assembly at a high rate of rotation. In order to maximize the utilization of the fluid draining from the collection chamber into drive chamber 80, it is important to seal the annular interfaces around jet tube 86*a* and 87*a* so that fluid does not leak at these locations. Sealing of these interface locations is provided by annular ring seals 86*b* and 87*b*, respectively.

In addition to modifying the unitary construction of the drive chamber, such as drive chamber 22, by configuring the jet flow nozzles 86 and 87 as separate and insertable component parts, it will be understood that the radial distance from the axis of rotation (axial centerline 28) to the outer flow tip of each jet flow nozzle can be a variable. In other words, the moment arm of each jet flow nozzle can be designed as a variable by changing the length of the jet flow nozzle for a variable torque-arm distance. It is contemplated that longer jet flow nozzles will be selected for use with larger rotor assemblies.

Referring now to FIG. 16, it will be understood that the FIG. 16 drive chamber 81 is virtually identical to drive chamber 80, except that the hexagonal shape of main body 88 (in lateral section) is changed to a square shape (in lateral section) for main body 99 which in turn assumes a more cubic shape or form.

All other components, features, and structures of drive chamber 81 are virtually the same as that of drive chamber 80. This includes bushings 84 and 85, jet flow nozzles 86 and 87, bores 89 and 90, and jet flow nozzle bores 95 and 96. Importantly, the jet flow nozzles 86 and 87 remain as separate, insertable components with a length (torque-arm distance) that can be varied depending on the size of the rotor assembly.

Figure 7:
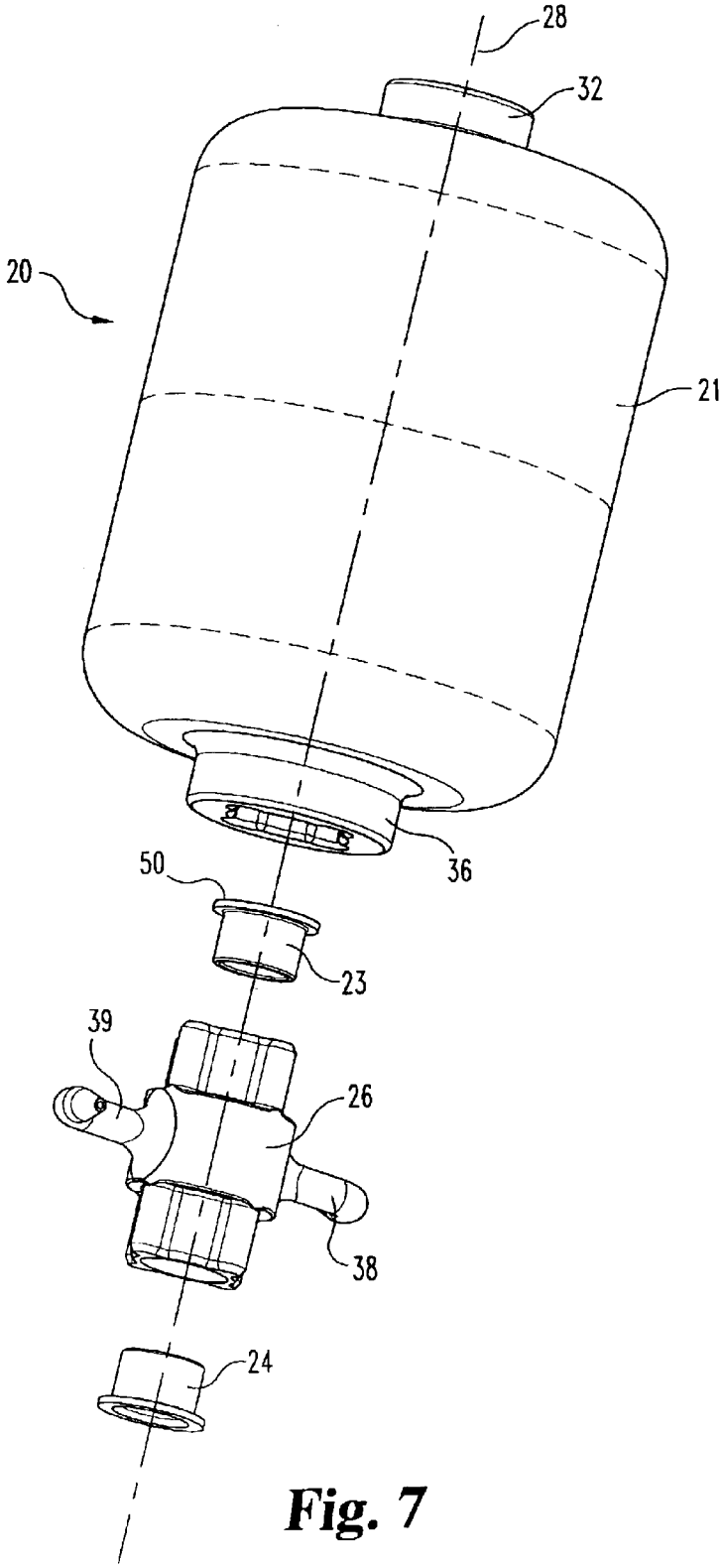
FIG. 7 is an exploded view of the FIG. 1 rotor assembly.

As should be understood, whatever horizontal cross sectional shape is selected for the drive chamber, or at least for the main body portion, requires a matching shape formed in the lower hub of the rotor collection chamber, assuming that some other feature or form is not incorporated in order to interfit the drive chamber and the collection chamber or rotor housing together. Ultimately, what needs to be achieved is a direct drive relationship or a keyed relationship such that the rotation imparted to the drive chamber by means of the jet flow nozzles is translated, one-for-one, into rotation of the collection chamber or rotor housing. In the context of the present invention, the contoured or ribbed form of upper section 44*a* results in the complementing and "matching" shape for lower hub 36, as illustrated in FIGS. 7–9. The use of matching shapes allows the drive chamber to be inserted (interfit) into the cooperating lower hub of the rotor collection chamber. When the ribbed form of upper section 44*a* is changed or reconfigured into either the hexagonal shape of main body 80 or the square shape of main body 99, the cooperating lower hub of the collection chamber (rotor housing) must be changed or reconfigured in a similar manner, such as hexagonal or square. The point to be made is that the main body and lower hub need to be keyed together such that there is no slippage or relative motion between these two components. In this way, whatever rotary drive motion is generated in the drive chamber, it is transferred to the collection chamber. This is the key to enabling a wider range of shapes.

Other keying concepts are contemplated by the present invention, including those illustrated first in FIGS. 17–20 and then in FIGS. 21–25. Referring first to FIGS. 17–20, the drive chamber 102 is constructed and arranged in a manner similar to drive chambers 80 and 81 except for two differences. First, in lieu of the hexagonal shape of drive chamber 80 and the square shape of drive chamber 81, drive chamber 102 is generally cylindrical and has a generally circular lateral cross section, except through the part-cylindrical key ways 103 and 104 in body 105. Bushings 106 and 107 and jet flow nozzles 108 and 109 are constructed and arranged and function in a manner virtually the same as bushings 84 and 85 and as jet flow nozzles 86 and 87, respectively.

The full cylindrical form of body 105 that is axially below the two key ways 103 and 104 defines a pair of drain passageways 112 and 113, each of which open into the bottom surface of the corresponding key way. The bottom surface of each key way is axially located just slightly above the upper edge of each flow jet nozzle bore 114 and 115.

Figure 25:
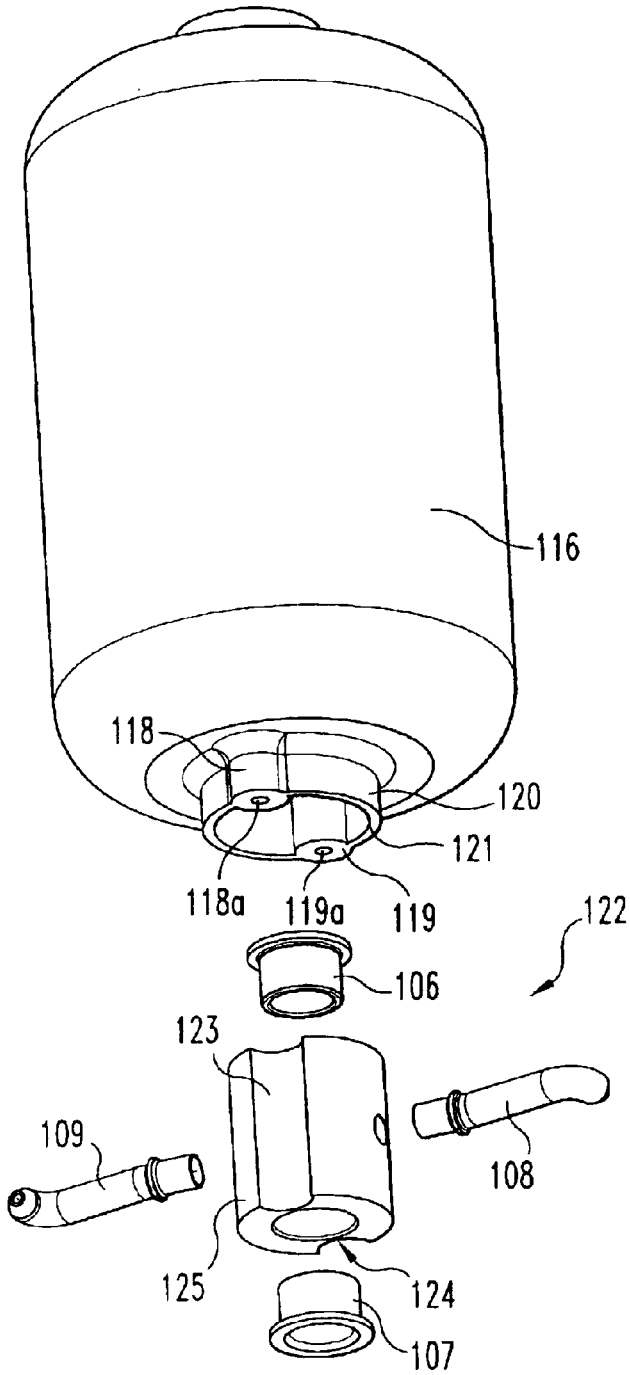
FIG. 25 is an exploded, perspective view, of the FIG. 21 drive chamber in combination with a rotor housing for completing a rotor assembly.

As will be understood from a review of FIG. 25 and from a review of the prior embodiments of the present invention, the cooperating assembly of a rotor into the drive chamber, such as drive chamber 102, includes a keying interfit of some nature. Whether ribbed, hexagonal or square, or some other shape, it is important to be able to easily assemble together the rotor housing and the drive chamber and to do so such that, as the drive chamber rotates due the high velocity flow exiting from the jet flow nozzles, the rotor housing rotates at a corresponding rate, without slippage and without any relative motion between the drive chamber and the rotor housing.

In the case of drive chamber 102, the cooperating rotor housing 116 (see FIG. 25) includes a pair of part-cylindrical ribs 118 and 119 that extend axially along the outer surface 120 of rotor hub 121. Ribs 118 and 119 function as keys for the necessary interfit between rotor housing 116 and drive chamber 102. This interfit is achieved by the insertion of keys 118 and 119 into key ways 103 and 104, respectively. While rotor housing 116 is illustrated as part of an exploded view (FIG. 25) that includes drive chamber 122 (see FIGS. 21–24), ribs or keys 118 and 119 are constructed and arranged to interfit into the key ways 103 and 104 or into key ways 123 and 124. Keys 118 and 119 each define a corresponding centered (i.e., concentric) drain passageway 118*a* and 199*a*, respectively. These are designed to align with drain passageways 112 and 113.

Referring now to FIGS. 21–24, drive chamber 122 is virtually identical to drive chamber 102 except that the key ways 123 and 124 axially extend the full length (height) of cylindrical body 125. Since key ways 123 and 124 extend the full length, separate drain passageways within body 125 are not required.

Figure 26:
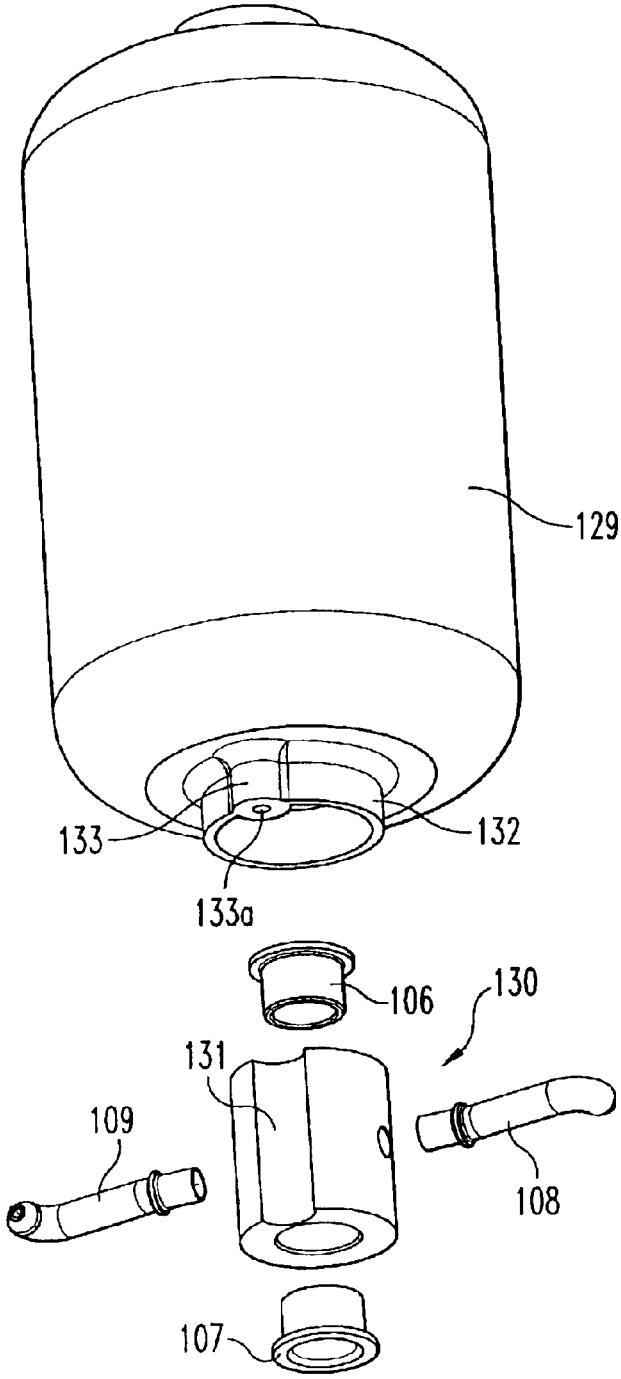
FIG. 26 is an exploded, perspective view of an alternative embodiment of a drive chamber and rotor housing combination according to the present invention.

Referring now to FIG. 26, a rotor housing 129 and drive chamber 130 combination is illustrated as an exploded view. Drive chamber 130 is identical to drive chamber 122 except that drive chamber 130 includes a single key way 131 as compared to the oppositely-disposed pair of key ways 123 and 124 that are defined by body 125 of drive chamber 122. In a cooperating manner, rotor housing 129 includes a lower hub 132 with a single part-cylindrical rib 133 that is constructed and arranged to interfit into key way 131. Rib (or key) 133 defines a concentric drain passageway 133*a*.

Figure 27:
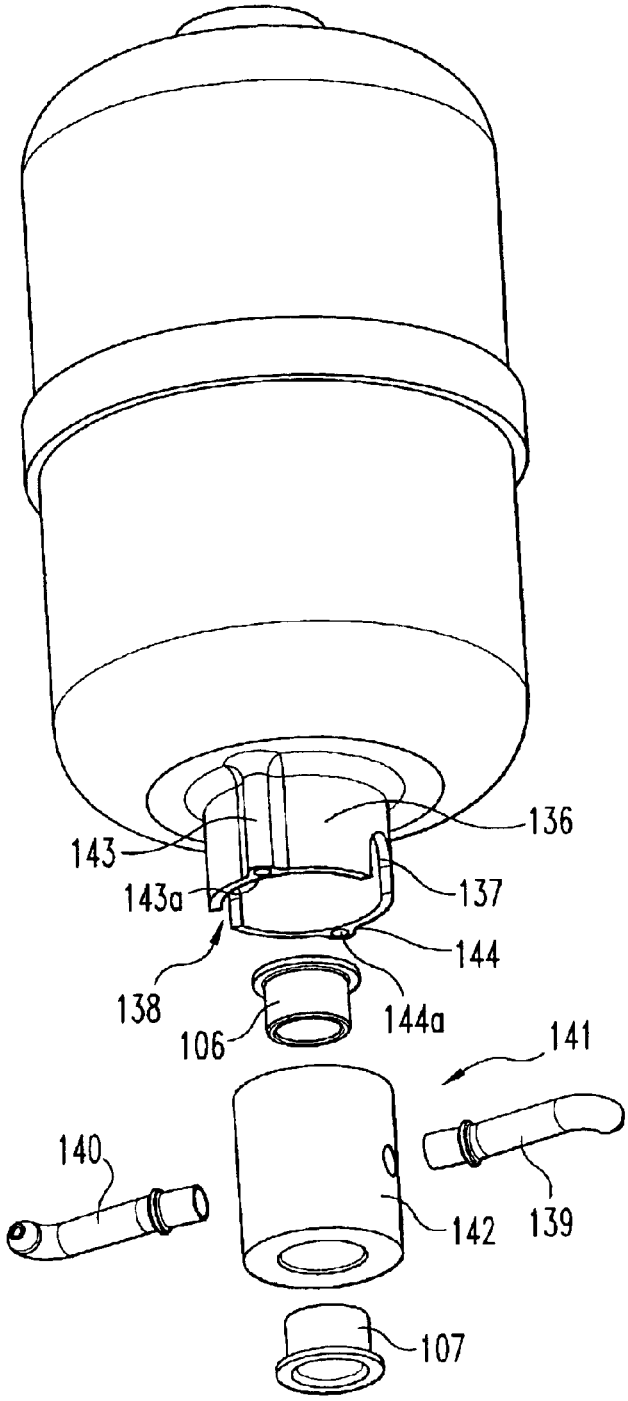
FIG. 27 is an exploded, perspective view of an alternative embodiment of a drive chamber and rotor housing combination according to the present invention.
Figure 28:
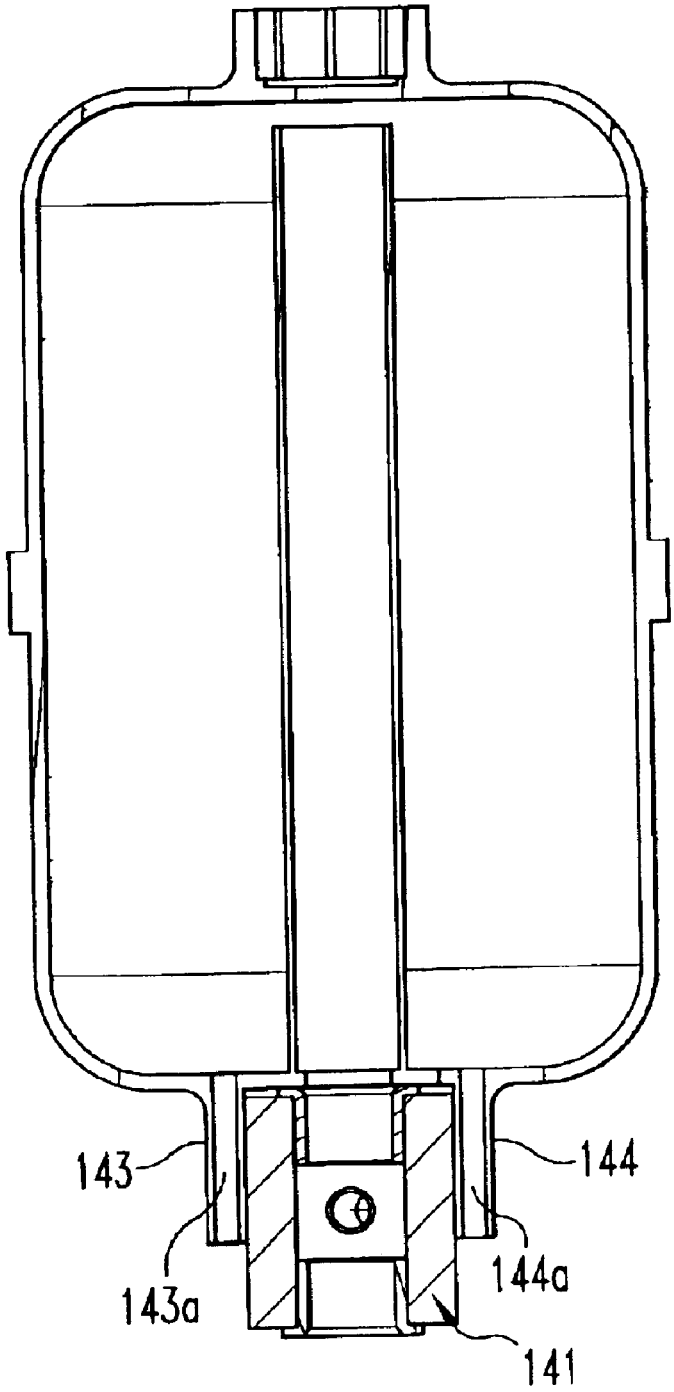
FIG. 28 is a front elevational view, in full section, of the completed assembly of FIG. 27.

Another structural configuration for interfitting the drive chamber into the rotor hub is illustrated in FIGS. 27 and 28 wherein rotor hub 136 includes a pair of axial slots 137 and 138 formed 180 degrees apart and aligned with the location of the jet flow nozzles 139 and 140 of drive chamber 141. The cylindrical body 142 has a sliding fit into hub 136, but there are no other contours to key or lock the body 142 and hub 136 together so as to prevent any relative rotary motion therebetween. The insertion of the body of each nozzle 139 and 140 into its corresponding slot 137 and 138, respectively, provides the rotary drive interfit or keying that is necessary. As the drive chamber rotates, the torque is transmitted through the body of each nozzle 139 and 140 to hub 136 in order to drive (rotate) the rotor housing.

The arrangement for providing one or more drain passageways is to mold hollow axial ribs 143 and 144 as part of the outer surface of hub 136 at circumferential locations 90 degrees apart from the axial slots 137 and 138. The defined passageways 143*a* and 144*a* open directly into the hollow interior of the rotor housing (see FIG. 28).

As will be appreciated from the various invention embodiments already illustrated and described, a number of different options exist for fluid drainage from the rotor housing. As would be understood, dirty fluid, such as oil, is introduced into the rotor housing and is processed by whatever particulate separate means is selected for the rotor assembly. Ideally, the heavy particulate matter is extracted from the fluid by means of the particulate separate means and deposited within the rotor housing while the cleaner fluid exits the rotor housing. Therefore, some type of passageway or passageways are required for the exiting fluid that drains from the rotor housing.

In some embodiments of the present invention, drain passageways are defined by the drive chamber and these passageways must be aligned with some complementing passageway or opening in either the rotor housing, the rotor hub, or some combination of both. In view of the fact that the rotor is typically encased within a centrifuge outer housing, the key to the fluid drainage task is that the fluid must exit from the rotor housing in a manner that complements the overall rotor design and the cooperating design of the drive chamber without detracting from the particulate separation efficiency, without adversely affecting the speed of rotation, and without compromising the overall ease of use and cleaning of the centrifuge by the end user.

Referring to FIGS. 29–34, various rotor and rotor hub designs are illustrated with different drain passageways and openings that are suitable for use as part of the present invention depending to some extent on the centrifuge design and its requirements, but focusing more on the design of the cooperating drive chamber that is interfit or keyed into the (lower) rotor hub.

Figure 29:
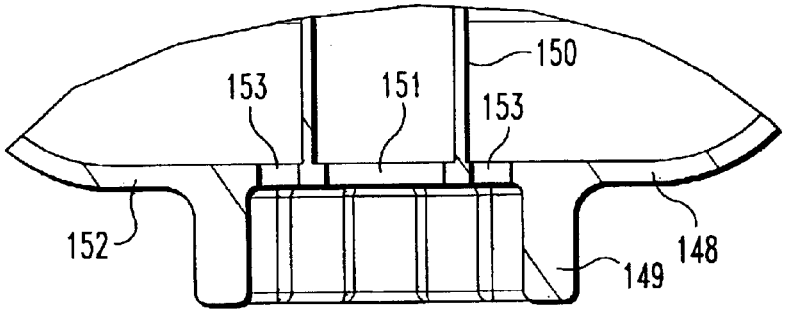
FIG. 29 is a partial, front elevational view, in full section, of an alternative rotor housing design according to the present invention.

Referring first to FIG. 29, rotor housing 148 includes a lower hub 149 with an integral centertube 150. A flow entrance 151 is designed in lower wall 152 and opens into the center of hub 149. A plurality of exit flow openings 153 are defined by lower wall 152 and open into the interior of hub 149. Since the exit flow openings 153 are interior to the hub, the drive chamber that inserts into hub 149 must provide aligned exit flow passageways.

Figure 30:
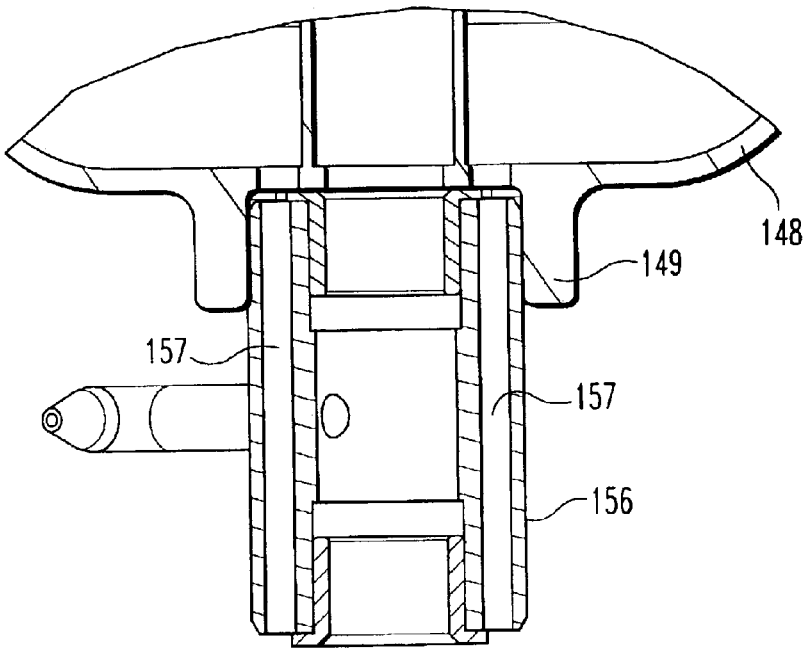
FIG. 30 is a partial, front elevational view, in full section, of the FIG. 29 rotor housing in combination with a drive chamber.

One example of how the drive chamber can provide aligned exit flow passageways is illustrated in FIG. 30 wherein drive chamber 156 is inserted into hub 149. Drive chamber 156 defines axial, flow passageways 157 that are equal in number and circumferential spacing to the exit flow openings 153 in rotor housing 148.

Figure 31:
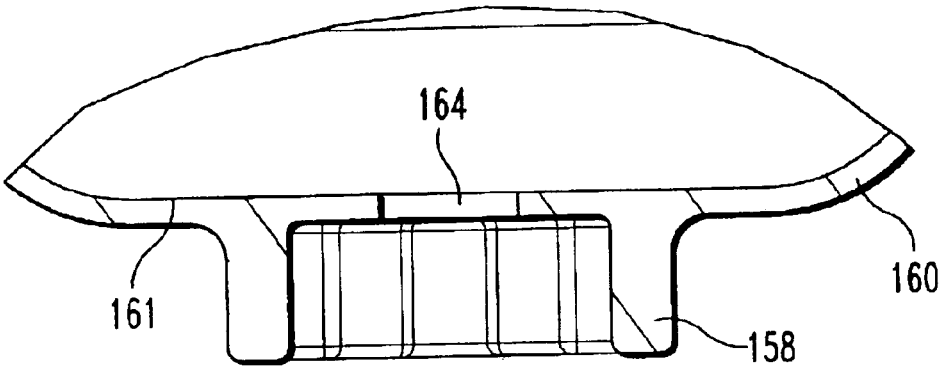
FIG. 31 is a partial, front elevational view, of a rotor housing according to the present invention.
Figure 32:
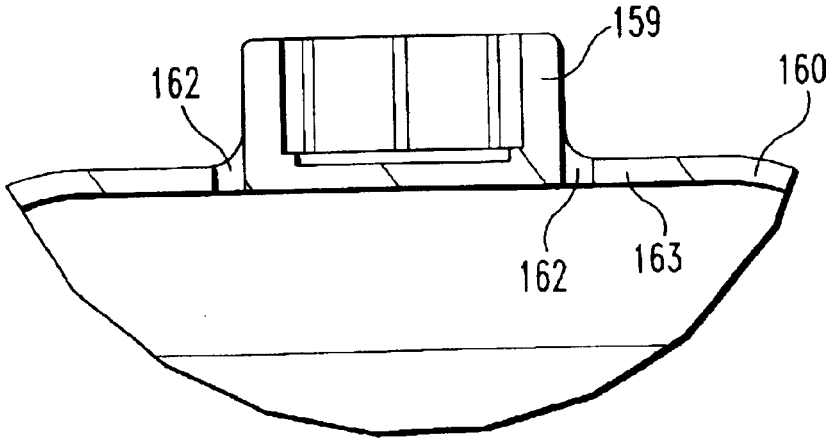
FIG. 32 is a partial, front elevational view of the FIG. 31 rotor housing including an upper hub.

Referring to FIGS. 31 and 32, it will be noted that lower hub 158 and upper hub 159 are both part of rotor housing 160. Rotor housing 160 does not include an integral centertube and the exit flow openings 153 of rotor housing 148 are removed from lower wall 161 adjacent hub 158. Instead, exit flow openings 162 are defined by upper wall 163, radially outwardly of upper hub 159. Lower wall 161 still defines a flow entrance 164, but the exit flow, i.e., fluid drainage, is relocated to the top of the rotor housing 160.

Figure 33:
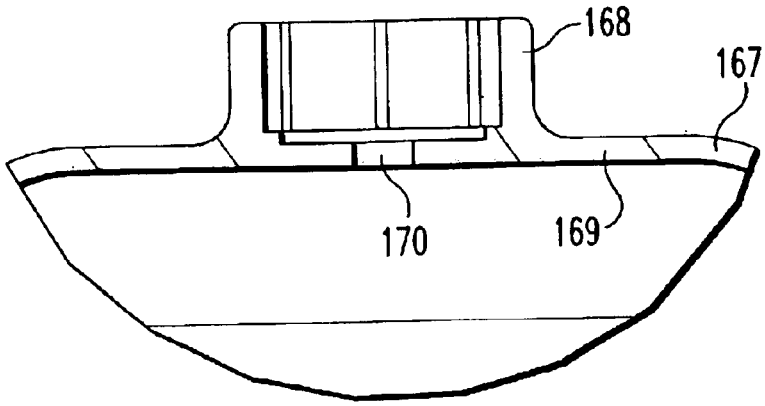
FIG. 33 is a partial, front elevational view of a rotor housing according to the present invention.
Figure 34:
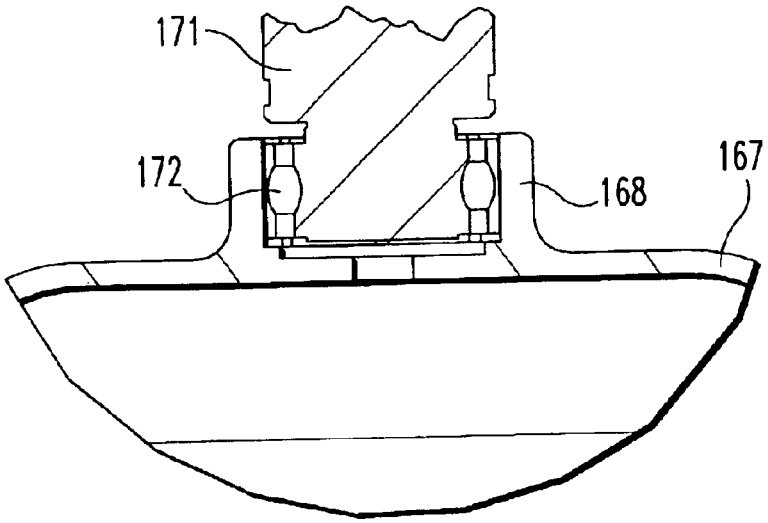
FIG. 34 is a partial, front elevational view of the FIG. 33 rotor housing with a support post assembled into an upper rotor hub.

Referring to FIGS. 33 and 34, the rotor housing 167 includes an upper hub 168 and upper wall 169 defines an exit flow opening 170. Since opening 170 is centered on the hollow interior of hub 168, it is important for the centrifuge component that interfits into hub 168 to provide a drainage flow path for the fluid to leave the rotor housing 167 and exit into the centrifuge housing.

In FIG. 34, a portion of this referenced centrifuge component is illustrated, as inserted (interfit) into hub 168. This component is a support post 171 that is bearing mounted for supporting the rotor assembly for high speed rotation. The bearing 172 that is illustrated is designed for the flow-through of fluid into the interior of the centrifuge housing (not illustrated).

Figure 35:
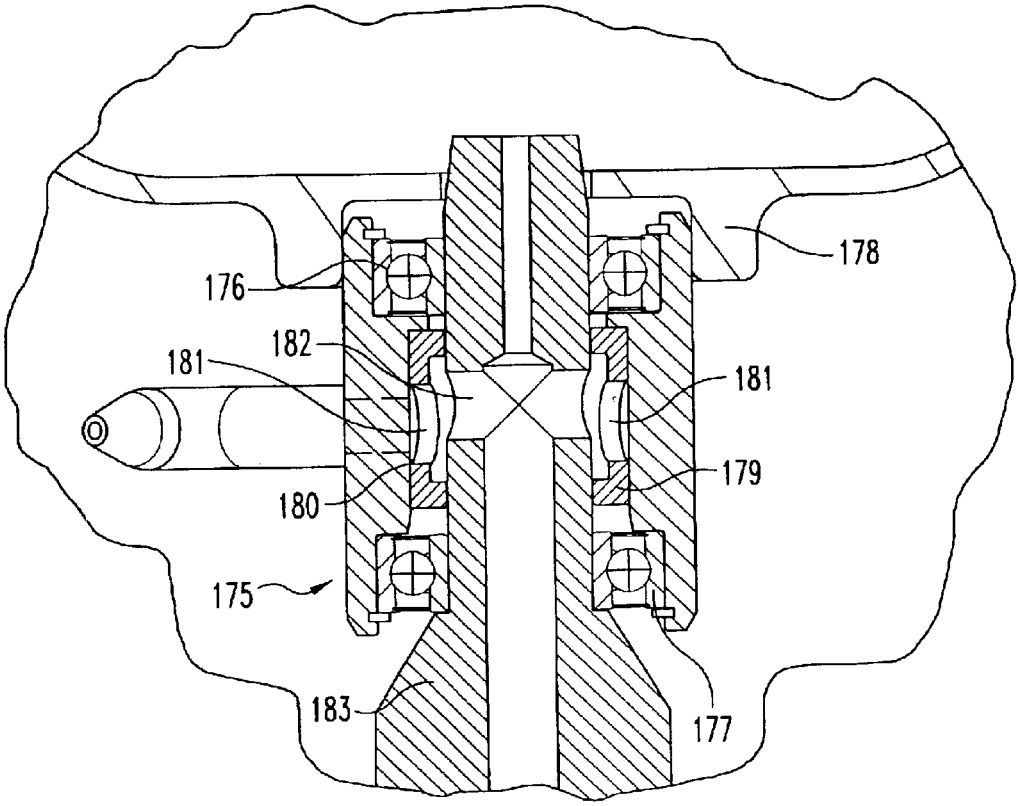
FIG. 35 is a front elevational view, in full section, of an alternative drive chamber according to the present invention.

Referring now to FIG. 35, another embodiment of the present invention is illustrated. In this design, the drive chamber 175 is configured with roller bearings 176 and 177 that replace the previously used flanged bushings. Many of the other design aspects of drive chamber 175 remain the same as what has been illustrated and described for the other disclosed drive chambers. This includes the flow jet nozzles and the keyed interfit of the drive chamber 175 into hub 178, regardless of the specific style or geometry of interfit that is selected. Accordingly, replacement of the flanged bushings by roller bearings or ball bearings is a design change that can be made to all previously disclosed drive chambers. In addition to the bushing-to-bearing change, the interior of drive chamber 175 includes a seal baffle 179 that is press fit into body bore 180. Baffle 179 includes at least two openings 181 to allow the flow of fluid through to the flow jet nozzles. As would be understood, the maximum rotational efficiency is achieved by throttling the flow into the rotor housing and by preventing any leakage from the drive chamber. This allows for maximum volume and pressure within the drive chamber and thus the maximum velocity (rotation) for a particular fluid volume and pressure.

When the flanged bearings are replaced by ball bearings or roller bearings, leakage through the bearings is a possibility. This is why the addition of seal baffle 179 is important. The specific placement of seal baffle 179 adjacent the flow exits 182 or post 183 ensure that, as the fluid flow exits from post 183 and is intended to be directed to the 183 ensure that, as the fluid flow exits from post 183 and is intended to be directed to the flow jet nozzles, the seal baffle 179 is constructed and arranged to prevent any leakage upwardly through bearing 176 or downwardly through bearing 177. As an alternative to the use of a separate seal baffle component, it is envisioned that the interior of the body of the drive chamber can be specifically machined with upper and lower radial ribs or flanges that have a dimensional sizing sufficient to establish a sealed interface against the post 183 at a location between the flow exits 182 and the upper and lower bearings 176 and 177, respectively. While a complete seal is not required, it is envisioned that the tolerances and sizing will be such that there will be a close fit with minimal clearance such that any leakage that might extend through the upper and lower bearings will be minimal.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A rotor assembly for use as part of a centrifuge for the separation of particulate matter from a fluid being processed by the centrifuge, said rotor assembly comprising:

a collection chamber constructed and arranged for receipt of a particulate separation mechanism, said collection chamber defining a flow aperture;

a drive chamber including a Hero turbine and being constructed and arranged to assemble to said collection chamber and to be separable from said collection chamber, said drive chamber defining a hollow interior in flow communication with said flow aperture;

a pair of bearing sleeves positioned at opposite ends of said drive chamber; and wherein said collection chamber includes a connection hub constructed and arranged for receipt of an insertion portion of said drive chamber, and wherein said connection hub defines a plurality of connection grooves and said insertion portion includes a matching plurality of connection ribs for the rotational slip-free assembly of said drive chamber into said collection chamber, and wherein at least one of said plurality of connection ribs defines a drain passageway.

2. A rotor assembly for use as part of a centrifuge for the separation of particulate matter from a fluid being processed by the centrifuge, said rotor assembly comprising:

a collection chamber constructed and arranged with a connection hub;

a particulate separation mechanism assembled into said collection chamber;

a drive chamber constructed and arranged with a Hero turbine for rotary motion of said drive chamber, said drive chamber including connection means for separable assembly of said drive chamber into said connection hub wherein any rotary motion of said drive chamber is imparted to said collection chamber;

a pair of bearing sleeves positioned at opposite ends of said drive chamber; and wherein said collection chamber includes a connection hub constructed and arranged for receipt of an insertion portion of said drive chamber, and wherein said connection hub defines a plurality of connection grooves and said insertion portion includes a matching plurality of connection ribs for the rotational slip-free assembly of said drive chamber into said collection chamber, and wherein at least one of said plurality of connection ribs defines a drain passageway.

3. A centrifuge for the separation of particulate matter from a fluid being processed by the centrifuge, said centrifuge comprising:

a centrifuge housing;

a rotor-support shaft fixed to said centrifuge housing; and a rotor assembly positioned onto said rotor-support shaft, said rotor assembly including:

a collection chamber constructed and arranged for receipt of a particulate separation mechanism, said collection chamber defining a flow aperture; and a drive chamber including a Hero turbine and being constructed and arranged to assemble to said collection chamber and to be separable from said collection chamber, said drive chamber defining a hollow interior in flow communication with said flow aperture;

a pair of bearing sleeves positioned at opposite ends of said drive chamber; and wherein said collection chamber includes a connection hub constructed and arranged for receipt of an insertion portion of said drive chamber, and wherein said connection hub defines a plurality of connection grooves and said insertion portion includes a matching plurality of connection ribs for the rotational slip-free assembly of said drive chamber into said collection chamber, and wherein at least one of said plurality of connection ribs defines a drain passageway.

4. A centrifuge for the separation of particulate matter from a fluid being processed by the centrifuge, said centrifuge comprising:

a centrifuge housing;

a rotor-support shaft fixed to said centrifuge housing; and a rotor assembly positioned onto said rotor-support shaft, said rotor assembly including:

a collection chamber constructed and arranged with a connection hub;

a particulate separation mechanism assembled into said collection chamber; and a drive chamber constructed and arranged with a Hero turbine for rotary motion of said drive chamber, said drive chamber including connection means for separable assembly of said drive chamber into said connection hub wherein any rotary motion of said drive chamber is imparted to said collection chamber;

a pair of bearing sleeves positioned at opposite ends of said drive chamber; and wherein said collection chamber includes a connection hub constructed and arranged for receipt of an insertion portion of said drive chamber, and wherein said connection hub defines a plurality of connection grooves and said insertion portion includes a matching plurality of connection ribs for the rotational slip-free assembly of said drive chamber into said collection chamber, and wherein at least one of said plurality of connection ribs defines a drain passageway.

5. A rotor assembly for use as part of a centrifuge for the separation of particulate matter from a fluid being processed by the centrifuge, said rotor assembly comprising:

a collection chamber constructed and arranged for receipt of a particulate separation mechanism, said collection chamber defining a flow aperture;

a drive chamber including a Hero turbine and being constructed and arranged to assemble to said collection chamber and to be separable from said collection chamber, said drive chamber defining a hollow interior in flow communication with said flow aperture; and wherein said drive chamber includes a body portion and a flow jet nozzle assembled to said body portion, said flow jet nozzle being constructed and arranged to be in flow communication with said hollow interior and to be selectively replaceable relative to said body portion.

6. The rotor assembly of claim 5 wherein said body portion defines a drain passageway.

7. The rotor assembly of claim 6 wherein said body portion has a substantially hexagonal shape in lateral cross section.

8. The rotor assembly of claim 6 wherein said body portion has a substantially square shape in lateral cross section.

9. The rotor assembly of claim 6 wherein said body portion has a substantially circular shape in lateral cross section.

10. A rotor assembly for use as part of a centrifuge for the separation of particulate matter from a fluid being processed by the centrifuge, said rotor assembly comprising:

a collection chamber constructed and arranged for receipt of a particulate separation mechanism, said collection chamber defining a flow aperture;

a drive chamber including a Hero turbine and being constructed and arranged to assemble to said collection chamber and to be separable from said collection chamber said drive chamber defining a hollow interior in flow communication with said flow aperture; and wherein said collection chamber including a connection hub and said connection hub including a keying rib and wherein said drive chamber defining a key way, said keying rib being assembled into said key way upon assembly of said drive chamber to said collection chamber.

11. The rotor assembly of claim 10 wherein said keying rib defines a drain passageway.

12. A rotor assembly for use as part of a centrifuge for the separation of particulate matter from a fluid being processed by the centrifuge, said rotor assembly comprising:

a collection chamber constructed and arranged with a connection hub;

a particulate separation mechanism assembled into said collection chamber;

a drive chamber constructed and arranged with a Hero turbine for rotary motion of said drive chamber, said drive chamber including connection means for separable assembly of said drive chamber into said connection hub wherein any rotary motion of said drive chamber is imparted to said collection chamber; and wherein said drive chamber includes a body portion and a flow jet nozzle assembled to said body portion, said flow jet nozzle being constructed and arranged to be in flow communication with said hollow interior and to be selectively replaceable relative to said body portion.

13. The rotor assembly of claim 12 wherein said body portion defines a drain passageway.

14. The rotor assembly of claim 13 wherein said body portion has a substantially hexagonal shape in lateral cross section.

15. The rotor assembly of claim 13 wherein said body portion has a substantially square shape in lateral cross section.

16. The rotor assembly of claim 13 wherein said body portion has a substantially circular shape in lateral cross section.

17. A rotor assembly for use as part of a centrifuge for the separation of particulate matter from a fluid being processed by the centrifuge, said rotor assembly comprising:

a collection chamber constructed and arranged with a connection hub;

a particulate separation mechanism assembled into said collection chamber;

a drive chamber constructed and arranged with a Hero turbine for rotary motion of said drive chamber, said drive chamber including connection means for separable assembly of said drive chamber into said connection hub wherein any rotary motion of said drive chamber is imparted to said collection chamber; and wherein said collection chamber including a connection hub and said connection hub including a keying rib and wherein said drive chamber defining a key way, said keying rib being assembled into said key way upon assembly of said drive chamber to said collection chamber.

18. The rotor assembly of claim 17 wherein said keying rib defines a drain passageway.

19. A rotor assembly for use as part of a centrifuge for the separation of particulate matter from a fluid being processed by the centrifuge, said rotor assembly comprising:

a collection chamber constructed and arranged for receipt of a particulate separation mechanism, said collection chamber defining a flow aperture;

a drive chamber including a Hero turbine and being constructed and arranged to assemble to said collection chamber and to be separable from said collection chamber, said drive chamber defining a hollow interior in flow communication with said flow aperture;

a bearing positioned at opposite ends of said drive chamber;

a seal baffle constructed and arranged to seal off fluid flow from said bearings; and wherein said Hero turbine includes a flow jet nozzle and said seal baffle defining a flow opening that is in communication with said flow jet nozzle.

20. A rotor assembly for use as part of a centrifuge for the separation of particulate matter from a fluid being processed by the centrifuge, said rotor assembly comprising:

a collection chamber constructed and arranged with a connection hub;

a particulate separation mechanism assembled into said collection chamber;

a drive chamber constructed and arranged with a Hero turbine for rotary motion of said drive chamber, said drive chamber including connection means for separable assembly of said drive chamber into said connection hub wherein any rotary motion of said drive chamber is imparted to said collection chamber;

a bearing positioned at opposite ends of said drive chamber;

a seal baffle constructed and arranged to seal off fluid flow from said bearings; and wherein said Hero turbine includes a flow jet nozzle and said seal baffle defining a flow opening that is in communication with said flow jet nozzle.

* * * * *